US005704554A

United States Patent [19]

Cooper et al.

[11] Patent Number: 5,704,554

[45] Date of Patent: Jan. 6, 1998

[54] ELECTROSTATIC SPRAY NOZZLES FOR ABRASIVE AND CONDUCTIVE LIQUIDS IN HARSH ENVIRONMENTS

[75] Inventors: Steven C. Cooper; S. Edward Law, both of Athens, Ga.

[73] Assignee: University of Georgia Reseach Foundation, Inc., Athens, Ga.

[21] Appl. No.: 620,088

[22] Filed: Mar. 21, 1996

[51] Int. Cl.[6] ..... B05B 5/00

[52] U.S. Cl. ..... 239/690.1; 239/692; 239/706

[58] Field of Search ..... 239/690, 690.1, 239/692, 695, 697, 704–8, 105; 361/227, 228

[56] References Cited

U.S. PATENT DOCUMENTS

| | | | |
|---|---|---|---|
| 3,516,608 | 6/1970 | Bowen et al. | 239/15 |
| 4,004,733 | 1/1977 | Law | 239/2 |
| 4,009,829 | 3/1977 | Sickles | 239/15 |
| 4,106,697 | 8/1978 | Sickles et al. | 239/15 |
| 4,343,433 | 8/1982 | Sickles | 239/3 |
| 4,664,315 | 5/1987 | Parmentar et al. | 239/706 |
| 4,735,364 | 4/1988 | Marchant | 239/690.1 |
| 4,762,274 | 8/1988 | Burls et al. | 239/690.1 |
| 4,991,774 | 2/1991 | Kelly | 239/3 |
| 5,044,564 | 9/1991 | Sickles | 239/705 |
| 5,181,661 | 1/1993 | Wollard | 239/704 |
| 5,188,290 | 2/1993 | Gebauer et al. | 239/3 |

OTHER PUBLICATIONS

Brochure entitled "What Growers Should Know About Air–Assisted Electrostatic Spraying," Electrostatic Spraying Systems, Inc. (1992).

S. Edward Law et al., "Advances in Air–Assisted Electrostatic Crop Spraying of Conductive Pesticides," 1992 International Summer Meeting, Paper No. 92–1062, The American Society of Agricultural Engineers (1992).

S. Edward Law, "Electrical Interactions Occurring at Electrostatic Spraying Targets" *Journal of Electrostatics*, Elsevier Science Publishers B.V. (1989), pp. 145–156.

S. Edward Law, "Electrostatic Pesticide Spraying: Concepts and Practice," *IEEE Transactions on Industry Applications*, vol. 1A–19, No. 2 (Mar./Apr. 1983), pp. 160–168.

S. Edward Law, "Embedded Electrode Electrostatic–Induction Spray–Charging Nozzle: Theoretical and Engineering Design," The American Society of Agricultural Engineers (1978) (reprinted from Transactions of the ASAE, vol. 21, No. 6, pp. 1096–1104 (1978)).

Brochure entitled "Electrostatic Sprayers for Greenhouses," Electrostatic Spraying Systems, Inc. (undated).

Brochure entitled "Air–Assisted Electrostatic Vineyard Sprayers," Electrostatic Spraying Stems, Inc. (undated).

*Primary Examiner*—Andres Kashnikow
*Assistant Examiner*—Lisa Ann Douglas
*Attorney, Agent, or Firm*—James L. Ewing, IV, Esq.; Kilpatrick Stockton LLP

[57] ABSTRACT

Air atomizing induction charging spray nozzles suited for use with conductive liquids, solutions, suspensions or emulsions. These systems feature a high level of the spray charging at low induction—electrode voltage and current. Primary benefits include consistent, reliable operation in harsh agricultural and industrial environments with a wide range of spray formulations, especially those having relatively high concentrations of abrasive and conductive materials. Internal and external surfaces are configured to minimize potential differences between electrode and ground. Such nozzles may employ external cavities, field concentrators, hoods and other structures and arrangements to affect aerodynamic flow of gases within the vicinity of the nozzles and electrostatic and electrodynamics effects such as those caused by electrical fields within the vicinity of the nozzles.

86 Claims, 11 Drawing Sheets

AIR FLOW SHOWN ON LEFT
ELECTRIC FIELDS SHOWN ON RIGHT

44 = SERIES RESISTOR INSIDE POWER SUPPLY

CIRCUIT REPRESENTATION OF POWER SUPPLY WITH A SERIES RESISTOR R CONNECTED TO A SPRAY CHARGING NOZZLE HAVING A CONTAMINATED SURFACE OF RESISTANCE Rn TO EARTH.

ELECTROSTATIC SPRAY NOZZLES FOR ABRASIVE AND CONDUCTIVE LIQUIDS IN HARSH ENVIRONMENTS

BACKGROUND OF THE INVENTION

This invention relates to electrostatic spraying devices in general, and in particular to pneumatic-atomizing, hydraulic-atomizing and other types of induction-charging spraying systems.

Several present-day methods exist to charge and deliver spray particles for the purpose of improving the quality and efficiency of mass transfer of spray material onto the intended target. Induction-charging types of electrostatic nozzles are often selected for use in certain industrial and agricultural settings because they generally use lower input voltage and current than other types of electrostatic nozzles, such as those which are based upon corona, contact or electrohydrodynamic charging principles which utilize voltages on the order of 25 to 50 kV or greater for adequate charging. There are basically two classes of induction spray-charging systems in the prior art. The first contains nozzles that position electrodes near a relatively wide hydraulic, pneumatic, or other type atomization zone and obtain sufficiently high induction charging field gradients at operational voltages on the order of 5 kV to 15 kV. Examples of this type are by Burls et al., Pay, Swanson, Sickles, Inculet et al., and Brown et al. The second class of induction-based devices contains nozzles that have internal embedded electrodes that are placed very near a better defined atomization zone and, because of the proximity of the electrode to the atomization zone, are able to develop sufficient induction charging field gradients at electrode voltages of only 1 to 3 kV. Examples of this latter type are by Law and by Parmentar et al.

The magnitude of the force by which charged droplets are electrically propelled toward the intended target is a function of the droplet charge level and the droplet size. Proper control of droplet size and adequate charging can result in greatly enhanced deposition efficiency, especially onto hidden regions of three dimensional targets. Conventional air-atomizing induction-charging devices by Law and by Parmentar successfully atomize water droplets into the desired size range for electrostatic effect of below 100 μm in diameter, and charge these droplets to the minimum desired level of at least 3 mC/liter. With these parameters, deposition increases of at least two-fold can be achieved compared to similar uncharged spray onto complex target geometries such as plant canopies encountered in agricultural crop spraying. But, when commonly used materials are mixed into the spray liquid and used in these prior art nozzles, charging levels may decline considerably over the time span considered as normal usage periods. For instance, over the course of half-day-long spraying with the Law nozzle (or commercial versions of it which are modified with a dielectric liquid tip), using mixtures of powders, conductive liquids or metals commonly used in agricultural pesticide and foliar nutrient spraying, charging levels can decline to less than one fifth of that achieved with water alone. Continued usage with these types of additives to the water, and in the contaminated environment encountered in industrial and agricultural spraying, can result in irreversible damage to the electrostatic spray nozzles and power supplies.

The decline in spray-charging level and the eventual destruction of nozzle components are due in large part to several electrical problems that arise from the formation of conductive deposits on interior and exterior nozzle surfaces. These deposits, however slight, create stray electrical current pathways that readily trace across surfaces of the nozzle and wires and hoses attached to the nozzle. This electrical tracking phenomenon occurs even with the relatively low voltages of approximately 1 to 3 kV associated with internal electrode induction charging nozzles, such as at levels described by Law and by Parmentar. Eventually, conductive black carbon deposits form along these stray current paths which etch into dielectric surfaces, establishing permanent electrical conductors which cannot be removed by the operator during normal cleaning. These electrical pathways can form on internal as well as external nozzle surfaces.

Stray Currents on External Surfaces

The most obvious stray current tracking paths form on external dielectric nozzle surfaces which are subject to gross contamination by moisture and particulates in the spraying environment. These current paths usually start on surfaces at the nozzle orifice near the high voltage electrode and extend outward from the electrode toward external surfaces of lower potential as the exposed clean dielectric surfaces of the charging nozzle become wetted or otherwise contaminated. Since the contamination creates a resistive conduit electrically connecting the electrode to earth, surfaces which lie between are at some voltage intermediate to that of the electrode and earth, depending on their location and the degree of surface contamination.

The first effect of the stray currents on external surfaces is to increase the power requirement of the system which tends to reduce the output voltage of the nozzle's unregulated electrode power supply. This causes proportional reductions of both the electrode voltage and the spray charge level. When insulating surfaces intended to separate earthed sprayer parts from the electrode become sufficiently contaminated, the electrode's current drawn from the power supply increases dramatically. Under clean conditions, with water, a Law or Parmentar nozzle may draw only 20 μA. However, as the nozzle surfaces become conductive through contamination by environmental moisture, particulates or spray liquid, the effective resistance from the induction electrode to ground is reduced and the resultant surface tracking causes the power supply output current to increase 200-fold or greater, depending on the output capability of the power supply. With unregulated types of supplies, which are normally used because of their inherent safety, the increased level of current causes the voltage to be reduced to below ⅓ of its unloaded output. The large power requirement also reduces the number of nozzles that can be operated from a single electrostatic power supply. The power demand from surface fouling has caused some manufacturers of commercial induction charging nozzles to utilize an individual power supply for each nozzle capable of output currents far exceeding the operational requirements of an uncontaminated nozzle. This design approach increases the complexity and cost of multi-nozzle systems such as agricultural boom sprayers, and the excessive power available can accelerate dielectric surface destruction from electrical tracking and cause safety problems. As taught by Law in U.S. Pat. No. 4,004,733 (which patent is incorporated herein by this reference), it may be desirable to mount the power supply directly to the charging nozzle or to embed it within the nozzle. The advantages discussed by Law are that this avoids any high voltage leads that may be susceptible to mechanical damage or can present an electrical hazard. Law shows the power supply mounted directly to the nozzle portion containing the electrode. The problem with this embodiment is that the low voltage power supply input wires will become contaminated and the insulation will eventually degrade by electrical activity along the insulation surfaces. The potential difference between the conductor on the inside of the low voltage line and the contamination on the wire is usually near that of the electrode potential. Therefore dielectric breakdown of the insulation is likely, especially if the insulation is weakened from mechanical damage or electrical tracking damage. In addition, there is usually an electrical connector somewhere on the low-voltage wires to allow the nozzle to be easily removed. The internal parts of the connector are at a low voltage and the outside of the connector is at a high voltage because of the conductive pathways which form on the wire insulation and/or on connector surfaces due to contamination. Therefore, in practice the low voltage connectors interiors and exteriors are also susceptible to failure because of the potential difference.

The device described by Parmentar et al. addresses the problem of electrical tracking on outer nozzle surfaces and attempts to limit the current by lengthening the surface insulation distance from the nozzle's outlet to the earthed mounting bracket with a series of grooves on the outer walls of the nozzle and a large radial flange surrounding the nozzle. But, since the grooves and flange are exposed directly to dust and to the charged spray cloud, they can quickly become sufficiently conductive to sustain substantial current from the electrode. In addition, the deep grooves can become filled with dried spray materials and are difficult to clean thoroughly and therefore can remain conductive after cleaning.

A second effect of stray current on external nozzle surfaces is to reduce the intensity of spray charging because of electrical contact with the liquid supply through seams in the liquid input connection on the nozzle body. When electrical contact with the normally earthed liquid is made, the liquid's potential is elevated toward that of the induction electrode. The potential difference between the induction electrode and the liquid stream is reduced, resulting in a proportional spray-charging level reduction.

Physical damage can occur from electrical arcing at contaminated insulation surfaces of wire, air tubes and liquid tubes near where these nozzle component surfaces contact grounded sprayer parts. Current from the electrode or contaminated high-voltage electrical connectors travels along the fouled surfaces and electrical arcing occurs on the surfaces near grounded sprayer parts, eventually eroding holes into the tubing and the wire insulation causing liquid leaks and exposed conductors which are subject to direct shorting.

Eventually the etching along current paths and pitting from electrical discharges permanently disfigure surfaces which are important to the basic function of the nozzle, such as the walls of the atomization channel, the liquid-orifice tip, and surfaces of the electrode. Erosion from electrical activity in these areas causes a disruption of the spray pattern, greatly affecting the spray charging level and atomization quality.

Stray Currents on Internal Surfaces

While charge flow across contaminated external nozzle surfaces does the most visible physical damage to conventional air-atomizing induction nozzles and accounts for much of the current drawn from the power supply, internal surfaces are also subjected to contamination. This contamination results in spray charge reduction when the potential of the liquid upstream from the electrode is influenced.

Some types of conventional induction charging nozzles use seals within the nozzle to insulate the liquid from the electrode positioned in the nozzle. The dielectric surfaces of these seals can become sufficiently conductive by contamination during disassembly to provide current paths to the liquid. The level of currents across the dielectric seals may not be sufficient to cause electrical arcing or surface etching. However the electrical contact can be sufficient to elevate the voltage of the liquid stream toward that of the electrode resulting in a significant reduction of the induction spray charging electric field. Some previous nozzles are designed so that they can be disassembled into all base component parts. While this allows convenient access to each part for inspection or replacement, it aggravates the problem of possible interior surface contamination because it has been found that some conductive residues can remain after normal cleaning and reassembly.

An example of how an interior surface can become inadvertently contaminated during disassembly is in the Law nozzle modified with a dielectric twin-fluid tip. The base of this twin-fluid tip is threaded into the nozzle body and the seam is subject to contamination during disassembly which results in an electrical tracking path between the liquid channel and stray surface currents originating at the electrode. It has been observed that this path can cause the liquid upstream from the electrode to reach a voltage of 40–70% of that of the electrode, resulting in a proportional reduction in spray charge.

Internal contamination also occurs in prior art nozzles when a small amount of spray material flows back into the air channels when air flow is stopped. This contamination creates gross electrical current paths on surfaces between the electrode and the preferably low-voltage liquid-orifice tip and liquid channel insulation. These surfaces can become pitted by electrical discharges. Holes eventually develop in the dielectric material surrounding the liquid-orifice tip or liquid channel, thus exposing the liquid channel directly to the voltage of the electrode and also to the pressurized gas cavity.

In one previous commercial version of the Law nozzle, the twin-fluid tip and its mating threaded base are conductive and grounded. A cover is installed over the electrode cap portion and the exposed metal of the twin-fluid tip. This strategy is aimed at holding the liquid at earth potential even in the presence of stray currents. Over normal usage periods and during cleaning of the nozzle, however, the surfaces on the inside of this cover become contaminated. Therefore, current travels outward from the electrode, across the contaminated cover seals, and along the contaminated inner cover surfaces toward the exposed metal at the base of the earthed twin-fluid tip. The liquid remains earthed, but the current path is direct through the conductive twin-fluid tip and the power supply output is severely reduced and is subject to failure from the excessive current demand. In an effort to eliminate this problem, the metal twin-fluid tip was replaced with a similar design tip made from Delrin plastic. This increases the life of the nozzle somewhat, but current paths to the liquid stream eventually penetrate the seam between the Delrin twin-fluid tip and the nozzle body with electrical arcing sufficient to eventually create grooves between the sealing surfaces and open continuous electrical pathways to the liquid stream.

Use of Resistors on the Power Supply Output

In some conventional electrostatic nozzles, such as that by Sickles, a resistor in the gigohm range is placed between the power supply output and the nozzle's electrode to limit current to the electrode for the purpose of operator safety and for preventing gross electrical arcing on the interior of the nozzle. This resistor can also have the beneficial effect of limiting leakage currents originating at the electrode, but spray-charging levels are reduced because very small leakage currents over contaminated surfaces cause a substantial voltage drop over the high-value limiting resistor connected to the electrode. When spray materials or airborne dusts eventually coat a dielectric nozzle, the effective resistance from the electrode to earth is reduced to a value much less than that of a power supply series resistor of a size that would adequately limit current to a safe value. In practice when prior art nozzles are operated in agricultural settings, the nozzle electrode resistance to earth is often reduced to much less than 1 megohm. The schematic shown in FIG. 13 illustrates the effect on the electrode voltage, $V_e$, for the case of a current limiting resistor, R, placed between a nozzle electrode and the power supply when a resistive leakage path, $R_n$, exists across nozzle surfaces to earth.

Consider the example of a 5 megohm current limiting resistor, R, connected between a 1 kV unregulated power supply and a contaminated nozzle having a 1 megohm resistive leakage path, $R_n$, from the electrode to earth along contaminated nozzle surfaces. As in a classical voltage-divider circuit, the voltage from the power supply is divided at the electrode, reducing the electrode voltage ($V_e$) and the internal induction charging field to only ⅙ of that of a nozzle with perfectly clean surfaces and no leakage currents. By further example, for $R=R_n$ the effective charging voltage is halved. These simple examples illustrate that nozzle charging components must maintain a significantly higher value of leakage resistance to ground than the proper size current limiting resistors from the power source if such resistors are to be used effectively. The primary benefits of such a high leakage-impedance system are safety, longer nozzle life, improved operational reliability with poorly maintained nozzles, consistent spray charging over a wide range of liquid conductivities, the ability to use very small power supplies with relatively low voltages, and the ability to power many charging nozzles from a single power source.

Sickles attempts to maintain a highly resistive pathway between the nozzle's electrode and ground by keeping nozzle surfaces clean using a secondary air stream designed to prevent charged spray from returning to the nozzle body. The volume of compressed air used for this secondary air stream, however, makes it impractical for large multi-nozzle systems such as 30 to 80 nozzle agricultural boom sprayers used for treating field crops. Air compressors or blowers must be as compact as possible in these mobile applications. Excessive pneumatic energy at the target is often undesirable as the electrostatic force field may be overcome by the aerodynamic forces resulting in poor electro-deposition and overspray. In addition, nozzles operating in this type of harsh environment tend to collect conductive airborne dusts and overspray on surfaces even when secondary air is used to move contaminants away from the nozzle.

Neutralization of the Charged Spray Cloud due to Ionization from Liquid Accumulating on the Nozzle Face The charged spray cloud emitted from an induction nozzle's orifice creates an intense electric field terminating on the intended target as well as on the nozzle face and other sprayer components. The space-charge imposed field at the nozzle causes a strong attraction force between the nozzle surface and the charged droplets. Conventional induction nozzles, such as by Law which utilize pneumatic atomization, have the benefit of a gas carrier to effectively propel most of the spray away from the nozzle face. Within the spray cloud itself, droplets are mutually repelled and some droplets on the outer periphery escape entrainment by the gas jet. Charged droplets that become free of the gas carrier jet and have not traveled a sufficient distance to escape the field at the nozzle face, however, return to the nozzle surface along the electric field lines imposed by the space charge field. This relatively small portion of charged spray returning to the nozzle causes much of the detrimental surface contamination and resulting electrical current problems. A further detrimental consequence is that the spray liquid which is attracted back to the nozzle tends to accumulate on the planar face of the conventional charging nozzle. This accumulation can cause partial neutralization of the charged spray. As the deposited liquid begins to drip away from the outer nozzle surfaces, it is pulled toward the spray cloud by the force of the spray cloud's electric field. The accumulated liquid is formed into sharp peaks aligned with the field. The intensity of the electric field at the peaks is sufficient to cause dielectric breakdown of the surrounding air. The resultant gaseous electric discharges send ionic charges of opposite polarity into the spray cloud, subsequently electrically neutralizing a substantial portion of the spray. In addition, the surface-accumulated liquid electrically drawn from the nozzle or dripping by gravity is wasteful and causes poor deposition from improperly atomized spray. The droplets dripping from a nozzle face are usually quite large and are charged opposite to the spray. In paint spraying applications, these large droplets mar an otherwise uniform surface coat. In the practice of pesticide spraying of plants, deposition of these large drops can cause severe plant tissue damage at sites where the overdose occurs.

The shape of the conventional Parmentar nozzle reduces ionization points forming from surface films at the nozzle orifice area by recessing the outlet in a cup-shaped cavity with the outer rim facing the spray cloud. However, ionization and dripping occur at other surfaces of the nozzle as they become sufficiently wetted. Charged droplets returning to the nozzle are attracted to the cavity's rim edge since the electric field lines are concentrated there. This helps limit the amount of spray that coats the body rearward of the rim edge, but the collecting droplets accumulate and coalesce on the edge itself. Just prior to dripping, the liquid is pulled toward the spray cloud into sharp peaks from which charge opposite of the spray cloud is emitted and tends to neutralize a significant portion of the charged spray cloud. Parmentar also incorporates a large radial flange around the nozzle. This flange serves to lengthen the insulating surface and block returning charged spray from coating the upstream portion of the nozzle body. However, the front and edge surfaces toward the spray cloud eventually become coated and multiple ionization-prone drip points form. In addition, the cup shaped cavity on the front of the nozzle prevents the nozzle from being used in an upward orientation since the cavity tends to fill with liquid which accumulates on the rim edge and drips into the cavity, eventually partially blocking the orifice and/or being ejected as large liquid slugs which dramatically degrade the spray deposition quality.

All versions of the conventional Law nozzle also exhibit the dripping and spray cloud neutralization problem, especially recent commercial versions where a planar-surfaced cover is installed for protection over the smaller planar face of the electrode cap. Compared to the Parmentar nozzle, the Law nozzle tends to collect less liquid since the face of the cover is less than half as large. However, the accumulation is sufficient to cause the formation of prominent, ionization-prone peaks dripping from the lowest edge of the face.

Mechanical Wear of the Atomization Channel

Another limitation in conventional induction charging nozzles is the tendency of the atomization channel and jet outlet to wear quickly under normal usage with sprays containing abrasive substances. The narrow spray pattern and air sheath created between the spray and channel wails by the Law nozzle limits the abrasion wear somewhat, but over time the atomization channel walls become slightly deformed with spray deposits left from improper cleaning or disfigured from electrical activity, such as induced ionization from the liquid orifice tip or current tracking along the inner walls of the atomization zone. The deformation disrupts the narrow pattern, and a portion of the air-driven spray impacts onto the plastic wall near the outlet and mechanically erodes it. In practice the outlet of the nozzle can erode to double the initial diameter in a period of only a half-day while spraying certain abrasive materials such as diatomaceous earth or sodium aluminofluoride. Left unattended, the electrode will also begin to wear, beginning at the outlet end and continuing rearward. Air consumption, spray charge, and atomization quality can all be adversely affected by the abrasive wear.

SUMMARY OF THE INVENTION

The present invention provides improved electrostatic spray charging nozzle systems for reliable spray charging with a wide variety of spray liquids, especially those containing relatively high mass concentrations of abrasive powders, metal elements, corrosive materials, and/or highly conductive materials. Such systems are also safer and more reliable in environments where nozzle surfaces are likely to become contaminated with spray and other material, nozzles are subject to operation by untrained operators and nozzle maintenance may be neglected. The systems also provide nozzles with low electrical power requirement to enable the operation of many electrostatic spray nozzles from a single miniature power supply or to allow operation of a single nozzle from a subminiature power supply which may be embedded, if desired, within the nozzle.

Pneumatic-atomizing induction-charging nozzle systems according to the present invention advance the art, among other ways, by (a) maintaining stability of the internal electrostatic charging field between liquid jet and induction electrode through electrical insulation of the liquid stream from internal and external current leakage, and through establishment of an electrical barrier between the internal charging field and spray cloud fields originating external to the nozzle; (b) maintaining nozzle surface potentials to preclude leakage of charge on interior and exterior nozzle surfaces; (c) creating high electrical resistance between earthed sprayer parts, the high voltage power source, and the electrode of the spray nozzle; (d) utilizing abrasion resistant materials at the nozzle outlet; and (e) shaping the external surfaces of the nozzle to minimize nozzle coating and neutralization of spray by space-charge induced ionization.

Nozzle assemblies according to the present invention include a body that terminates in a twin-fluid tip which is nested into a cover that contains a pneumatic atomization chamber and charging electrode. The induction electrode is properly positioned in the assembly in relation to the atomization zone so as to concentrate and maintain a suitably intense electric field at the surface of the liquid jet at the droplet-formation zone. The liquid jet is maintained at or near ground potential and connected to ground at an appropriate upstream location. Charge is induced to flow through the liquid and concentrate on the surface of the liquid jet entering the atomization zone in response to the electric field at the jet surface. Droplets are formed with pneumatic energy which also propels the charged spray away from the electrode area, through the nozzle jet outlet and toward the intended target.

According to one aspect of the present invention, the nozzle assembly consists of a body that terminates in a twin-fluid tip which is removably connected to a cover. The cover features a conically or other aerodynamically shaped outer surface that terminates in a spray jet outlet. It contains an interior surface that forms an atomization channel and includes an induction electrode. The body and cover can be easily separated to provide access to all the areas that periodically need to be cleaned; including the air channels, liquid channel, liquid-orifice tip, atomization channel, charging electrode surface, and air plenum area. The liquid-orifice tip, electrode and other internal nozzle components are integral to the body or cover and do not need to be removed. They are, therefore, not subject to misalignment or contamination during reassembly, disassembly or operation.

According to another aspect of the present invention, the electrode's electrical contact with the power supply is interrupted when the cover is loosened or removed. This reduces the chance that an operator will inadvertently contact the power supply when inspecting or cleaning the electrode or other portions of the atomization zone. This feature also eliminates handling and straining any fragile wires while cleaning the atomization channel or other areas.

Several aspects of the nozzle according to the present invention eliminate stray currents across contaminant surface films which readily form on interior dielectric surfaces of induction charging nozzles, such as surfaces in the areas around the liquid-orifice tip and the atomization chamber. On the interior surfaces of the nozzle according to the present invention, equipotential surfaces are intentionally maintained in the areas of the cover portion adjacent to and upstream of the electrode. The surfaces of the gas plenums, seals, and the atomization channel, which are internal portions of the cover assembly, are positioned between the electrode and a conductive or semiconductive annulus which is at a potential similar to the electrode. This equalizes the voltage on these dielectric surfaces, in the very likely event a conductive, contaminant film forms on them, and prevents current from traveling rearward from the electrode toward the lower-potential body portion of the assembly and forming damaging electrical tracking paths on these key internal nozzle areas. The internal conductive annulus also conveniently serves to make alignment-independent electrical contact from the power supply conduit in the body to the electrode in the cover. A further benefit of the interior charged annular surface is that it inherently imposes an electrical barrier between the internal induction charging electric field and any externally originating fields existing around the nozzle, such as that imposed by the spray cloud space charge, which is opposing and will suppress the nozzle's spray charging field.

The liquid channel, liquid inlet connections, and liquid tip are contained within the low-voltage body portion. The liquid is grounded at some point upstream of the liquid orifice and the parallel resistance of the stream segment and its seamless conduit between the ground point and the electrode causes the potential of the liquid jet at the orifice to float between ground voltage during normal operation and the electrode voltage during a gross short circuit situation. In the event of a direct short circuit between the liquid-orifice tip and the electrode caused by a bridge of conductive contaminant, the current is caused to move through the bridge of material causing the short, and through resistive liquid stream and its conduit. The liquid between the tip and its upstream ground point forms a resistor, which self-limits current and subsequently limits damage to nozzle components. Damage is further prevented as the nozzle liquid flow is stopped because current ceases when liquid contact discontinues as the liquid is evacuated from the channel at the liquid orifice tip.

Chances of a short circuit at the liquid-orifice tip are further limited by the atomizing gas moving in the plenum surrounding the base of the tip and by the very high velocity gas which is forced into the atomization zone surrounding the liquid-orifice tip. For additional safety and to prevent an electrical short between the electrode and liquid orifice tip, which is likely to occur in the absence of atomizing gas flow through the atomization channel, the electrode voltage is preferably disconnected by way of a pressure switch controlling the power supply.

Several aspects of the present invention greatly reduce stray currents on nozzle exterior surfaces compared to prior art nozzles operating in conditions where nozzle surfaces may become contaminated. It has been discovered that when contaminant films form readily on the external dielectric surfaces of electrostatic spray nozzles, the surfaces adjacent to and downstream of the electrode are then sufficiently conductive to electrically couple the electrode to earthed components of the sprayer. The resulting stray surface currents cause disfigurement and eventual destruction of dielectric surfaces, electrode surfaces, fluid connections and wires of prior art spray-charging nozzles. A primary aspect of the present invention is the maintenance of a highly resistive path from the electrode to earth, thereby preventing significant charge flow from the electrode along the interior walls of the atomization channel rearward toward the twin-fluid tip and forward toward the exterior face of the nozzle and along contaminated exterior dielectric surfaces attached to ground points on the sprayer. The highly resistive path is created by protecting selected portions of nozzle surfaces from contamination. A method to maintain a high impedance path is to properly form cavities into selected nozzle surfaces, and/or on electrical standoffs which are used to connect the nozzle to grounded sprayer parts, and protect the interior of these cavities from contaminant entry. Protection from intrusion of contaminants into the cavities can be provided by applications of aerodynamic, sonic, thermal, electrical, mechanical, or other forms of energy input or passively by properly shaping the cavities to inherently prevent contaminant entry by interaction with the existing electrical fields, imposed electrical fields, and aerodynamic flow fields nearby. In a preferred embodiment of the invention, the aerodynamic shape of the nozzle aims to create a generally laminar flow on the nozzle surfaces in order to reduce proclivity of entrained particles to adhere to the nozzle surfaces, while certain carefully placed electrical field concentrators, such as rims or edges, create areas of field intensity which tend to repel or deflect such particles.

In one embodiment according to the present invention, the dielectric nozzle body, on which the gas, liquid and electrical terminals are located and mounting connections are made, is electrically insulated from the cover portion by protected cavities formed into the body. The exterior body surface is thus maintained at near ground by the conductivity of the contaminated body surface and appreciable electrical current flow across the body surfaces from nozzle high voltage components is prevented by the resistivity of the protected cavity interior. A preferred embodiment also includes a protected surface on the cover portion of the nozzle assembly containing the internal electrode. This protected cavity further isolates the electrode from earth in the likely event of surface fouling, and thus causes the atomization channel and other external cover surfaces to elevate to a potential similar to the electrode and be held at that potential, thereby preventing charge flow from the electrode across all surfaces adjacent to the electrode.

The potential imposed on the exterior surface of the cover is opposite in sign of that of the spray droplets, but this does not significantly increase the attraction of charged droplets towards the nozzle surface over that of a grounded nozzle surface, nor does charged spray impacting the cover cause significant power supply current. Once the initially clean dielectric surfaces of the charging nozzle body and cover become soiled with conductive contaminant films, they respectively take on the electric potentials approximating those of the grounded mounting attachment and of the induction electrode. The less current drained from these contaminated surfaces, the closer they will approximate respective equipotential surfaces.

The magnitude of the space-charge electric field created by a negatively charged spray cloud has been measured to be over −3 kV/cm at a distance of 10 to 15 cm below the spray-jet centerline at the nozzle outlet. Therefore, the space charge potential is near −35 kV relative to a grounded nozzle surface and −36 kV relative to a cover surface elevated to the +1 kV electrode voltage. A charged cover at +1 kV may preferentially attract negatively charged spray, but the force is only 3% greater compared to a ground surface of similar geometry and proximity to the spray cloud. As negatively charged spray deposits on the charged cover a neutralization current is caused to flow from the induction electrode in order for the cover to maintain its potential, but the required current is very small. Assuming a 1% spray "rollback" to the nozzle, with ⅔ going to the cover surface, a typical 10 μA spray cloud current would require only 66 nA from the electrode's power supply for neutralizing rollback. In practice, much less than 1% rollback of the charged spray is likely.

Nozzles according to the present invention greatly reduce charged spray rollback and particulate deposition on selected nozzle surfaces by proper shaping of the nozzle exterior. The nozzle shape creates ambient air flow fields, creates beneficial electric field patterns from the nearby potential of the charged spray cloud, and creates strategic curvilinear electric field shapes between fouled dielectric surfaces on which electrical potentials are intentionally maintained.

Charged droplets returning to the face of the spray nozzle and causing induced-electrical-discharge neutralization of the spray cloud and electrical tracking is a problem encountered with all prior commercial versions of the Law device and other induction charging nozzles. That is because they have generally planer face surfaces perpendicular to the axis of the droplet-laden gas jet. Liquid deposit may be especially heavy in situations where the nozzle is spraying upward, or is spraying horizontally, or in situations where oppositely charged nozzles are spraying toward each other, such as with vineyard sprayers.

To reduce spray deposition onto the nozzle of the present invention, the surface finish is made smooth and is generally preferably conical or otherwise aerodynamically shaped, forwardly tapering so as to be as narrow as possible at the jet outlet. This conical forward taper terminating at the high velocity jet causes entrainment of a significant volume of ambient air. The entrained ambient air flows across the smooth nozzle exterior toward the main spray jet and creates an air "curtain" across the openings of the cavities, helping to prevent particulate entry. In addition, the air flow across nozzle surfaces helps prevent contaminant deposition and redirects particulates and stray spray droplets toward the intended target. The entrained gas volume adds to the outer layer of the main gas jet exiting the nozzle. This added mass flow tends to propel slower droplets on the outer periphery of the spray cloud in the intended direction away from the nozzle, overpowering electrical forces causing droplet roll-back. With planar-faced nozzles the peripheral droplets tend to readily return and deposit on the nozzle surface.

To further reduce spray deposition and liquid accumulation on the nozzle according to the present invention, the electric field lines originating from the electrical potential of the spray cloud are caused to concentrate at the forward end of the nozzle, nearest to the main gas/spray jet. The forwardly tapered shape of the cover reduces the deposition surface area immediately adjacent to the charged spray cloud and the increased curvature at the outlet causes the greatest portion of the electric field lines to terminate on the conductive-film surface just around the spray jet. Charged droplets returning to the nozzle are thus preferentially attracted toward this area of sharp curvature and, since the air flow field is also most concentrated in this region, nearly all droplets approaching this region are re-entrained into the main gas/spray jet prior to deposition and discharge on the nozzle face. The small amount of liquid which does deposit on the surface near the jet outlet is immediately pulled by strong venturi action into the main gas/spray jet and re-atomized before dripping and consequential induced ionization can occur. Some liquid spray material may deposit on the upstream surfaces of the conical cover, although the influence of the spray cloud's field is made much weaker there by the distance from the main cloud and by the continuous smooth shape. In this case the liquid does not readily accumulate sufficiently to drip or initiate induced ionization, because the liquid is steadily drawn into the main jet by the sheath ambient air which is entrained towards the flow of the nozzle's main gas jet.

Beyond the mechanical exclusion methods for protecting the interiors of cavities, and the protection afforded by the previously discussed air curtain caused across nozzle surfaces and the cavity openings by ambient air entrained by the compressed gas jet exiting at the forward end of the nozzle; further protection from entry by charged spray is achieved by properly shaping electric field lines at cavity entrances to cause charged spray to be repelled away from the openings. As discussed previously, the nearby charged spray cloud imposes a "space-charge" force field on the order of 2 to 3 kV/cm which drives charged droplets from the region of the charged spray cloud toward the intended earthed target. This space-charge field also results in electric field lines which terminate on the nozzle itself. The energy of the gas carrier is sufficient to propel nearly all the spray away from the nozzle, but a portion moves toward the nozzle surfaces along these field lines. These space-charge field lines terminate perpendicularly on conductive contaminated nozzle surfaces. In addition to the field imposed by the presence of the charged spray cloud, strong electric fields are also present between the high voltage cover and the low voltage body surfaces of the nozzle according the present invention. These two fields are complementary in flow direction. On planar surfaces the field lines are spaced evenly, but at surface discontinuities the electric field lines are much more concentrated. One aspect of the present invention is to place discontinuities or field concentrators on the nozzle surface to concentrate field intensity and cause electric field lines of a curvilinear shape which result from both the potential of the spray cloud and the potential intentionally maintained on nozzle surfaces. Charged spray droplets approaching the curved field lines experience strong centrifugal forces and are thrown outward away from the cavity openings, into the ambient air-flow field and re-entrained into the main spray cloud directed toward the intended target.

In a preferred embodiment of the present invention the exterior surface of the cover is generally a forwardly converging cone shape and surrounds the atomization and charging zone. The cover surface is preferably a dielectric material and becomes sufficiently contaminated when exposed in a spraying environment to become somewhat conductive. Therefore, a beneficial electric field boundary is maintained which surrounds the internal charging induction field to effectively decouple it from the opposing space charge field created by the presence of the highly charged spray emitting from the nozzle outlet.

The previously discussed protected cavity interior surfaces of the nozzle according to the present invention results in a high impedance between the nozzle's electrode power supply and ground and significantly reduces the current from the power supply compared to previous nozzles. This high impedance now allows the successful implementation of a protective resistive element in series with the nozzle, between the power supply and the induction charging electrode without suffering significant voltage drop at the electrode. In a preferred embodiment of the present invention this resistive element should be contained within the nozzle itself. A configuration where the power supply is mounted within the nozzle would simply have a resistor at the power supply output. In the event of multiple nozzles connected to a remote power supply, a resistor could be placed in the power supply in addition to the individual resistive elements within the nozzles. Or multiple output resistors could be placed within the power supply itself with direct connections to the nozzle. Resistive wire may also be employed to achieve this objective. If multiple nozzles are to be powered from a single source it is preferred to use an output resistor for each nozzle to prevent a shorted nozzle from affecting the others. One of the benefits of a resistive conduit between the power supply output and the high impedance nozzle's electrode is safety. The system can be designed so there is no noticeable shock when handling an energized nozzle. Other benefits observed due to a series resistor used in concert with a high impedance nozzle are the significant reduction in power supply current drawn due to induced electrical ionization of the liquid jet and consequential ion current from the induction electrode. Such ion currents have been noted in prior art nozzles once the electrode becomes wetted or has exposed edges or other discontinuities.

The high impedance nature of the nozzle according to the present invention lends itself to successful positioning of the power supply on or within the nozzle. Not only does the reduced power supply current and voltage allow the use of very miniature DC-to-DC converters which can be conveniently fitted to the nozzle or enclosed within it, but the low voltage leads or battery providing input to the power transformer can be protected from damage due to electrical tracking originating at the electrode. In previous designs, such as that by Law, where the power supply was attached to the nozzle or contained within it, the low voltage leads emanated from a surface of the nozzle which was susceptible to contamination and to voltage and current from the electrode. If the power supply is to be mounted onto the nozzle or embedded in a portion of it, the preferred embodiment would have the low voltage input wires or connectors emanating from the low voltage section of a high impedance nozzle, such as that disclosed here. This would prevent coatings of contaminant material on the outside surfaces of the wire insulation or insulation surrounding connectors from reaching an electrical potential near that of the electrode, resulting in electrical breakdown of the insulation. The power supply itself could be mounted to the high voltage section with the low voltage input conductors protected from contamination by positioning them within the low voltage nozzle portion.

An additional primary feature of the nozzle according to the present invention is the use of a hard, abrasion resistant material which is incorporated into the atomization channel to prevent premature electrical or mechanical etching of this channel. In the preferred embodiment, ceramic is chosen for its abrasion resistance and electrical insulation characteristics. Certain types of ceramics which are made electrically conductive can be used as an electrode material. The abrasion resistant electrode may form a portion of the walls of the atomization channel or make up the entire channel surface.

In the preferred embodiment of the present invention the atomization-zone channel is a straight bore, diverging at the jet outlet, as opposed to a converging channel which has been used in previous designs and can cause build up of material in the channel or at the jet outlet.

In addition to these objects, features, and advantages of the present invention, other such objects, features, advantages and benefits of the invention will be apparent with reference to the remainder of this document.

DETAILED DESCRIPTION OF THE INVENTION

Figure 1:
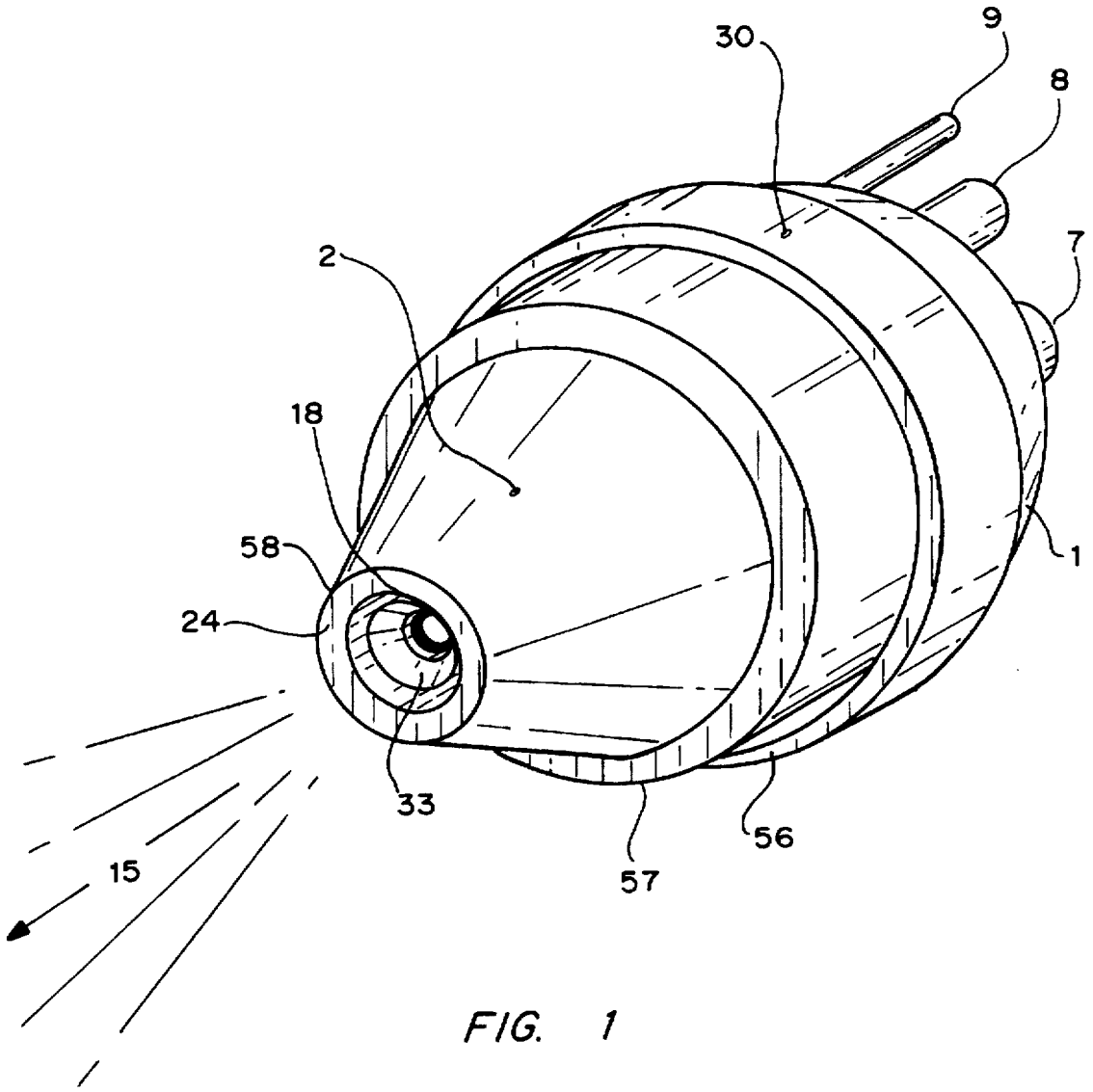
FIG. 1 shows a perspective view of an assembled first embodiment of the induction spray charging nozzle according to the present invention.
Figure 2:
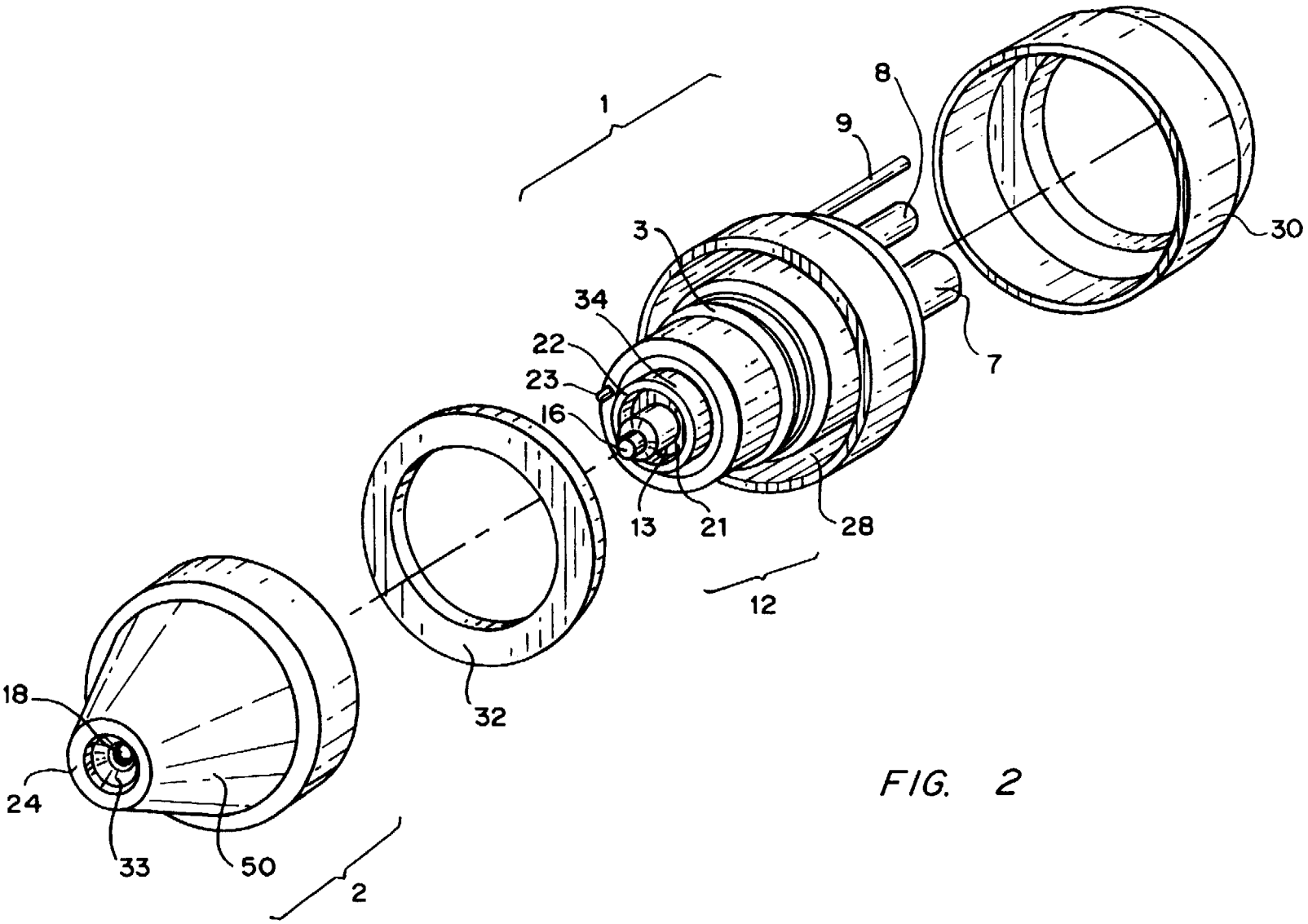
FIG. 2 shows a perspective view of a disassembled first embodiment of the induction spray nozzle according to the present invention.

FIG. 1 shows a form of preferred embodiment of induction charging nozzles according to the present invention. In this embodiment, the nozzle is broadly comprised of a body 1 and a cover 2. The liquid inlet 8, gas inlet 7 and electrical input 9 are located on the rear face of the body portion 1. Charged spray in a gas carrier 15 is emitted from the forward end of the nozzle through the outlet 33. The nozzle's conically shaped cover 2 tapers toward the outlet face 24. A hood 30 is shown positioned onto the body portion 1 of the nozzle. Referring to FIG. 2 which shows a disassembled embodiment, cover 2 can preferably be readily detached from the body 1 exposing the inner regions for servicing. The cover 2 preferably fastens onto the body 1 and is made easily separable using threads 3, or by screws, latches or other attachment means which allow disassembly for inspection, cleaning and reassembly without misalignment or damage by untrained persons and preferably without tools or with the use of common tools. The downstream end of the body is shaped into a twin-fluid tip 12 containing gas outlet 21 and plenum 13, and liquid orifice tip 16. Electrical contact with the power supply can be made through a contact terminal 23 which mates to the annular conductive surface 19 shown in FIG. 3.

Referring again to FIG. 3, in which a cross sectional view of a nozzle according to a preferred embodiment of the invention is shown, the nozzle body 1 is preferably formed of a dielectric material, preferably having low-surface wettability, low surface and volume conductivity values, and low surface adhesion properties. The body 1 contains conduits for gas 4, liquid 5, and electrical power (not shown in this view, refer to FIG. 9, numeral 6). The inputs of gas 7, liquid 8, and electrical power (See FIG. 1, numeral 9) are preferably located on the rear face 10 of the body 1 at the farthest distance from the face 24 of the nozzle. The gas input 7 can be made to accommodate a filter screen 11 if desired.

The fluid conduits 4 and 5, as well as the electrical conduit, are usually formed continuously through the nozzle body 1 without seams or separations in the body. In some cases however it may be desirable to make a liquid orifice tip 16 which is pressed or threaded into the body 1 in cases where it is desired to make the tip 16 itself from a dissimilar material, such as ceramic, or to make it periodically replaceable. It is not desirable to permit a seam which can be contaminated and therefore expose the liquid to the induction electrode voltage through stray currents on the nozzle surfaces. In some cases it may be desirable for the power supply to be encapsulated within or attach onto the nozzle body 1, thus eliminating a high voltage wire from the outside of the body portion 1.

Figure 3:
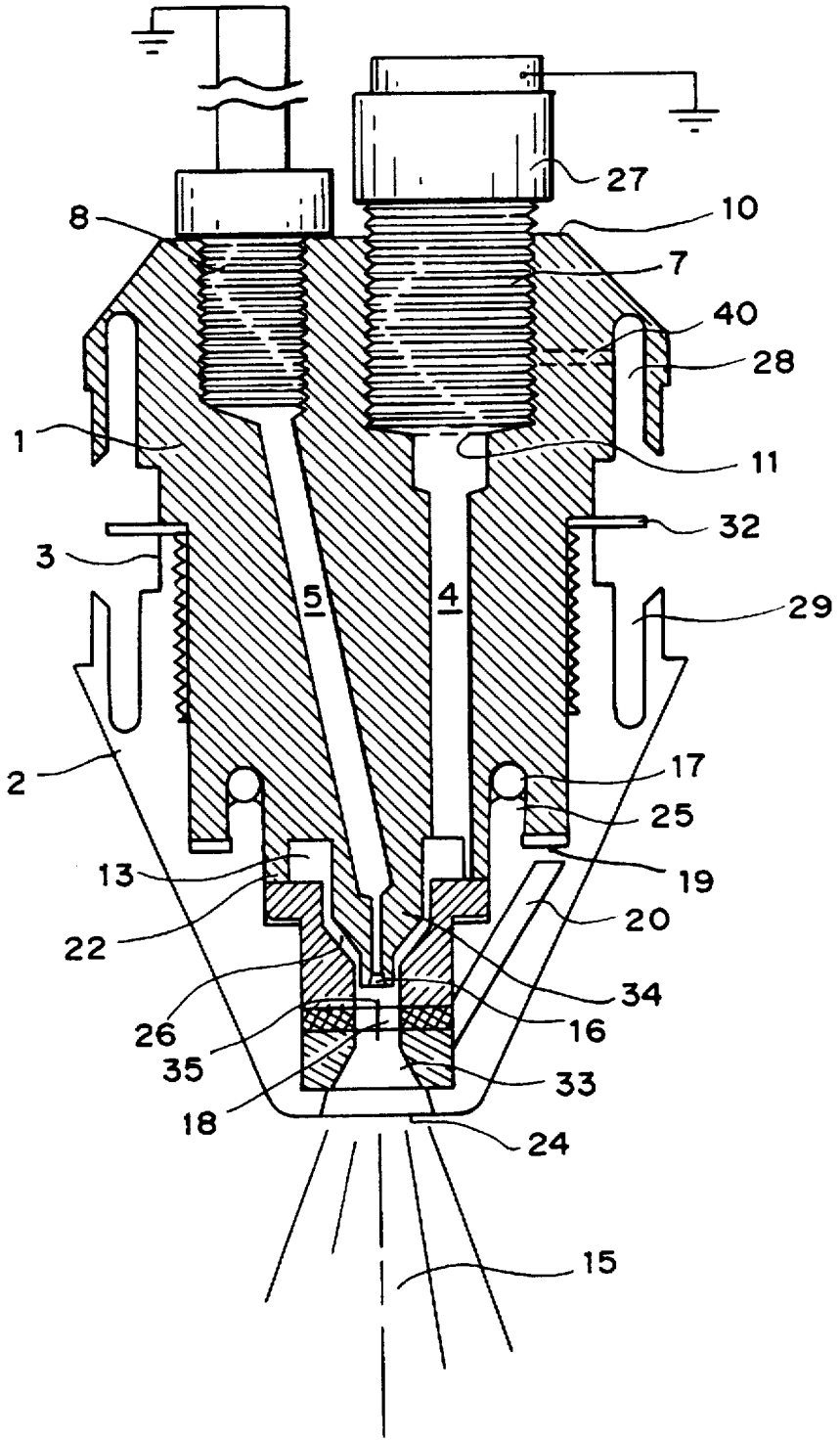
FIG. 3 shows a cross-sectional view of the first embodiment of the induction spray charging nozzle according to the present invention.
Figure 4:
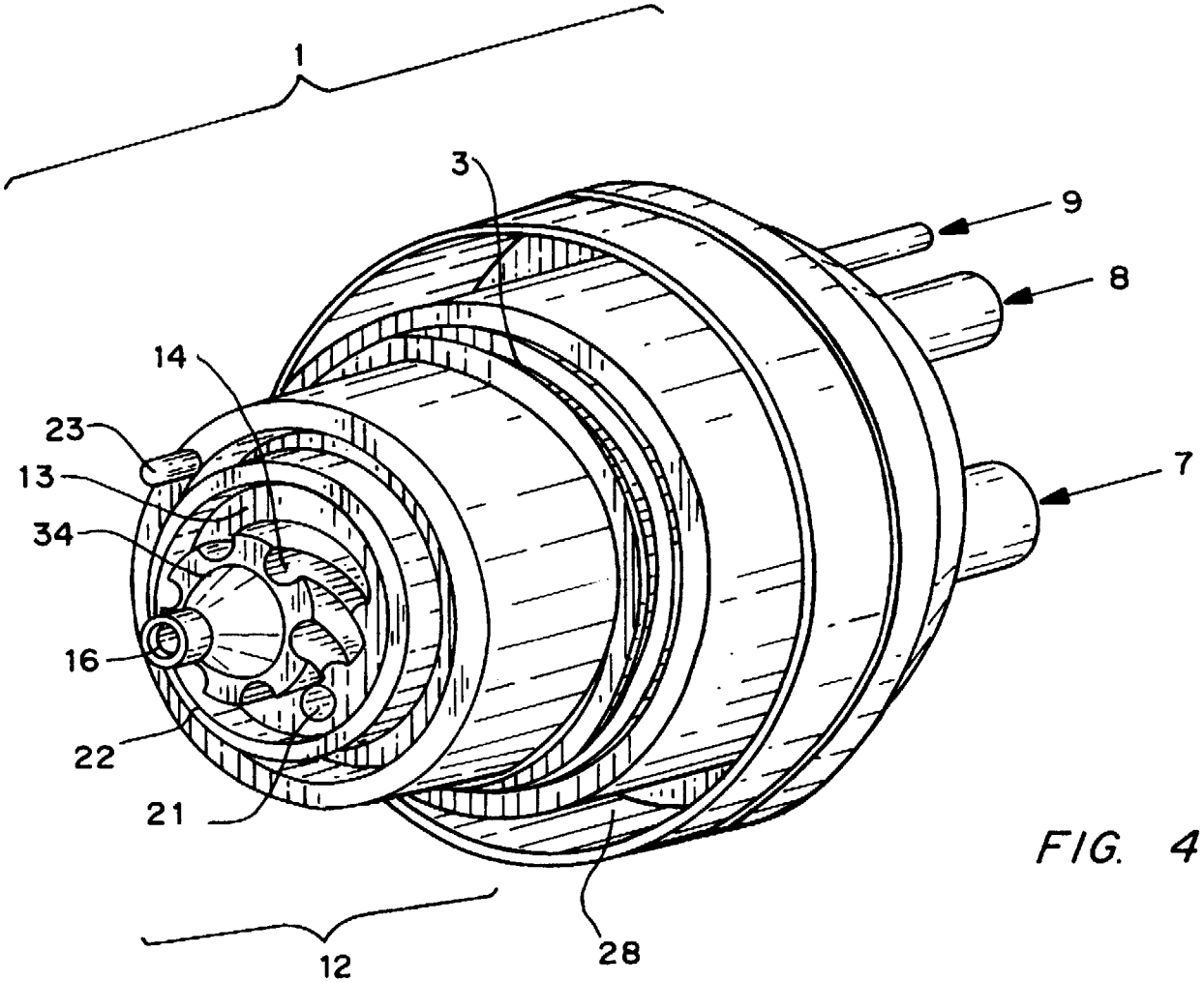
FIG. 4 shows a detailed perspective view of the twin-fluid tip section of an embodiment of the induction spray charging nozzle according to the present invention where air channels are used to direct air into the atomization zone.

The body terminates in a twin-fluid tip 12, as shown in FIG. 2 and a slightly modified version in FIG. 4. As seen in FIG. 3, the gas conduit 4 through the body 1 terminates at an outlet 21 into a plenum 13 which surrounds the base of the twin-fluid tip 12. The outer rim 22 of the plenum 13 may serve to seal against the base of the plenum 26 in the cover portion 2. Additional sealing may be provided by a flexible seal 17 against the rim 25 formed on the interior of the cover 2. These seals prevent gas leakage and also serve to limit the interior surface current paths. Pressurized gas from the plenum 13 can be channeled through multiple ports 14 surrounding the base 34 of the twin-fluid tip as shown in FIG. 4, or, as in FIGS. 2 and 3, the base 34 of the twin-fluid tip 12 can be made more narrow and smooth to allow gas to completely flow around the circumference of the base 34. The latter is preferred for maximum electrical isolation of the fluid tip 12. However, if a gas channel is needed in this area to direct the air flow, then slotted channels 14 are preferred to holes since the sidewall surfaces of the slots are exposed when the cover 2 is removed and they can be cleaned more easily than the insides of holes. These slots can be made in the axial direction of the spray stream 15 or the slots 14 can be formed at an angle (as shown in FIG. 4) if a radial motion of the exiting gas is desired to create a wider spray angle.

The liquid conduit 5 terminates in the outlet of the liquid-orifice tip 16. In general it is preferred that the orifice tip 16 be placed upstream from the electrode 18 as shown in FIG. 3. But, it has been found that the location of this tip 16 can be varied to achieve desired atomization and charging qualities and to vary the liquid flowrate.

Referring again to FIG. 3, formed within the interior of the forward end of the cover 2 of the nozzle is a gas plenum 26 which surrounds the base 34 of the twin-fluid tip 12. The gas plenum 26 serves to equalize, accelerate, and direct the flow of pressurized gas into the atomization zone and can form part of the wall of the atomization channel 35. The shape of the plenum 26 is shown generally as a frustrum transitioning to a cylinder, which works well for a narrow directed spray, but other configurations may be used which can result in a modified spray pattern. The gas plenum 26 positioned around the base of the tip 12 helps to keep the area free of gross contamination while it is pressurized. When gas pressure is removed, spray liquid may drip into the atomization zone 35 the plenum area 26, and for this reason it is preferred to utilize a simple pressure switch to control the electrode power supply. Otherwise, arcing between the electrode 18 to the tip 16 could occur in the absence of gas flow. It is also preferred that the gas pressure remain for a short time after liquid flow is stopped to purge the tip 16 of remaining liquid by the venturi action.

In the preferred embodiment of the present invention, a conductive induction electrode 18 is properly positioned so that its inner surface forms part of the wall of the atomization channel 8, preferably downstream from the liquid-orifice tip 16. Forward or downstream, preferably, of the electrode 18 is the atomization channel jet outlet 33 which serves to direct the spray jet and cover the forward edge of the electrode 35. The jet outlet 33 is preferably, but need not be, formed from abrasion resistant materials such as ceramic. It is not necessary that the outlet 33 be non-conductive, and hard conductive materials, such as stainless steel, may be selected, although insulating materials would be preferred for personnel safety. Prior art induction charging nozzles tend to wear or degrade in the jet outlet area when atomizing liquids containing abrasive powders or harsh chemicals. Nozzles according to the present invention incorporate a jet outlet preferably formed of ceramic. Typically an alumina industrial ceramic is chosen for this purpose because of extremely high resistance to wear and degradation by acid solutions, alkaline solutions, salts, and solvents. Alumina ceramics exhibit a hardness level that exceeds nearly all other materials. In addition, these types of ceramic exhibit high dielectric strength, high surface resistivity, low surface wettability and low porosity. The ceramic shape can be molded using standard ceramic part forming techniques. Certain alumina ceramics of a type having glass bonded mica, such as the Corning product "MACOR" are particularly suitable for forming the jet outlet 33 by standard machining methods.

Principal concepts of this electrostatic spraying system include the maintenance of surface potentials on selected nozzle components and the maintenance of a highly resistive path from the electrode 18 to ground. Chief benefits include the prevention of surface current tracking, reduction of induced ionization at the nozzle face, a reduction in the size and output of the power supply, and increased safety. To eliminate surface charge flow, the exterior and interior nozzle surfaces contacting the electrode 18 through surface contamination are maintained at a voltage similar to the electrode 18. The body of the nozzle 1 is sufficiently insulated from the cover 2 so that in the event the rear base surfaces 10 become contaminated they will be at near ground potential with minimal current to fluid connections 7 and 8 and grounded sprayer parts to which the body 1 may be eventually connected.

A method of achieving a high electrical resistance between the nozzle's electrode 18 and grounded portions is by physically protecting selected portions of the nozzle surfaces from contamination by spray or other materials which may deposit on the nozzle and cause the formation of stray current paths. The embodiments of FIGS. 2 and 3 show an example of a current-limiting cavity 28 which is formed on the body portion 1 and an additional current-limiting cavity 29 which is formed into the cover portion 2. These cavities 28, 29, which may be annular or any other desired shape, create regions which are partially sheltered from spray or other contaminants and a highly resistive surface is preserved. Charged spray returning to the nozzle as driven on electric field lines lacks sufficient kinetic energy to readily penetrate into the cavity depth and most deposits on the cavity edge where the field lines are concentrated. If spray material or other liquids eventually deposit inside the cavity 28 or 29, the quantity is usually small and liquid does not accumulate to form a continuous path, liquid films being much more conductive than discrete small droplet deposits. The cavities 28, 29 can be cleaned periodically and are easily accessed when the body 1 and cover 2 portions are separated.

In cases of nozzles operating in certain harsh conditions, gas jets 40 (shown in FIG. 3) may be directed into the cavity 28, 29 to continuously or periodically purge the cavity interior. For example, when atomizing gas supply is not a concern, some of the gas could be directed through several small diameter holes 40 drilled radially or somewhat tangentially outward from the gas conduit 4 creating a pressure gradient and an active gas sweeping of the body cavity 28 to exclude particulate deposition on the interior.

Figure 5:
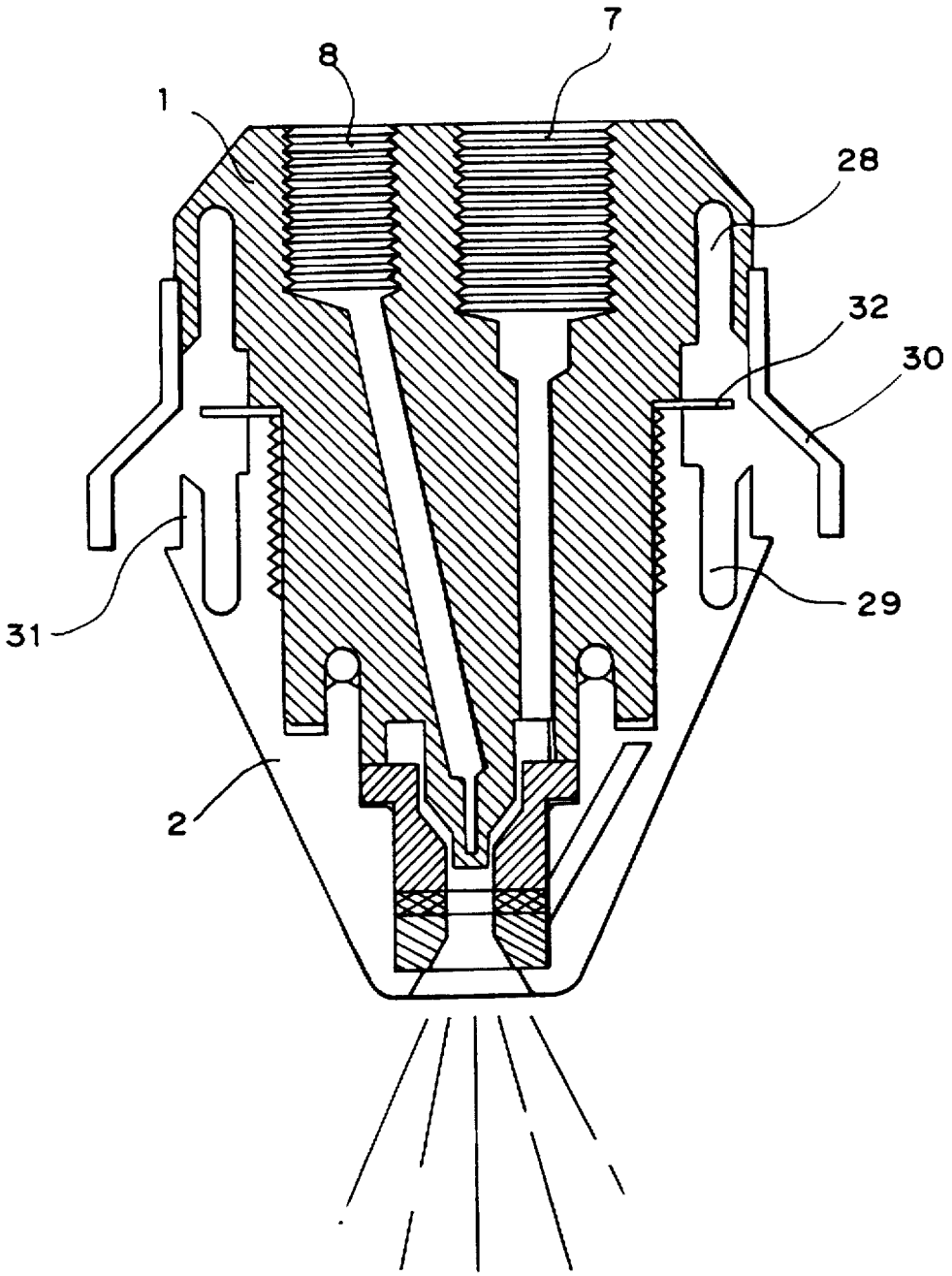
FIG. 5 shows a cross-sectional elevational view of a second embodiment of the induction spray charging nozzle according to the present invention, which includes a hood.

Further protection from surface contamination within cavity interiors is afforded by adding shields for mechanical shelter and to create beneficially shaped electric field lines to prevent charged droplet entry. An example of such a shield is shown in the cross-sectional view of FIG. 5 (although other structures or forms may be employed). This outer shield in the form of a hood 30 serves to further protect nozzle outer surfaces and the surfaces of nozzle body cavity 28 and the cavity of the cover 29. The hood 30 may be placed as shown for downward nozzle orientations, or inverted and fitted to the cover on the seat 31 for upward nozzle orientations. In addition, further protection can be added by the placement of a dielectric annular disk-shaped barrier 32 placed between the body and cover. This barrier 32 further covers the cavities 28, 29 and creates a maze of surfaces to deflect or otherwise limit entry and surface deposition of charged spray or other contaminants which may be traveling in air currents around the nozzle. The outer hood 30 and inner barrier 32 can be made as an integral part of the nozzle body or made separately, preferably formed from a dielectric material with low surface wettability, low volume and surface conductivity, and low surface adhesion characteristics, such as UHMW or PTFE.

Figure 6:
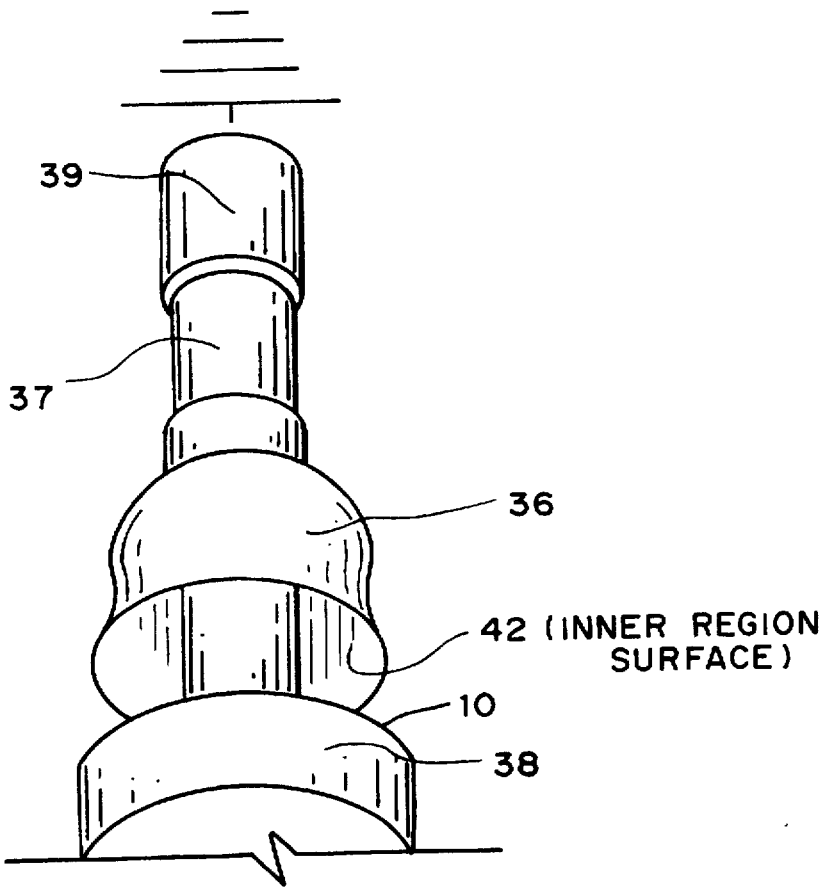
FIG. 6 shows a perspective view of a third embodiment of the nozzle system according to the present invention.

Another shield configuration to preserve high resistance pathways from the nozzle's electrode 18 to ground is shown in FIG. 6. In this example embodiment of the present invention, a basically hood-shaped shield 36 is placed between a charging nozzle 38 and a grounded sprayer part 39. In this example, the dielectric standoff structure 37 is the gas and/or liquid lines entering the rear face 10 of the nozzle. The shield 36 mechanically protects the dielectric standoff support 37 from contamination. It also beneficially modifies the electric field to prevent charge droplet deposition on the shield interior.

Additional hoods, cavities or other shielding methods can be added to the nozzle body, cover, nozzle mountings, tubing or wires, placed one on top of the other so as to form a labyrinth, or otherwise added and/or configured if greater degrees of insulation are necessary. Often perforated outer shields offer protection from electro-deposition on inner surfaces while allowing accumulated liquid (or rain) to escape.

According to the present invention, the nozzle surfaces are configured to influence the shape and concentration of the space-charge electric field lines imposed on the various body 1 and cover 2 surfaces for the purpose of beneficially influencing the trajectory of charged spray droplets returning to the nozzle. A properly charged spray cloud emitted from an induction charging nozzle typically imposes a passive space-charge field of 2 to 4 kV/cm magnitude at planar nozzle surfaces. Onto planar, smoothly continuous contaminant-conductive surfaces of the nozzle, the space-charge field lines terminate uniformly spaced and perpendicularly. As angular surface discontinuities are encountered, the field lines still terminate perpendicularly, but are more concentrated at convex shapes, and less concentrated within the interior of concave shapes. For the nozzle according to the present invention, potentials are maintained on nozzle surface films, and cavity edges and other nozzle surfaces are intentionally shaped so that an active curvilinear electric field is imposed to protect nozzle surfaces from charged spray deposition. Charged droplets moving along such curved field lines experience strong centrifugal forces which effectively repel them from the cavity opening area, and away from the nozzle, into an air flow field, thus protecting these zones from deposition.

Figure 7:
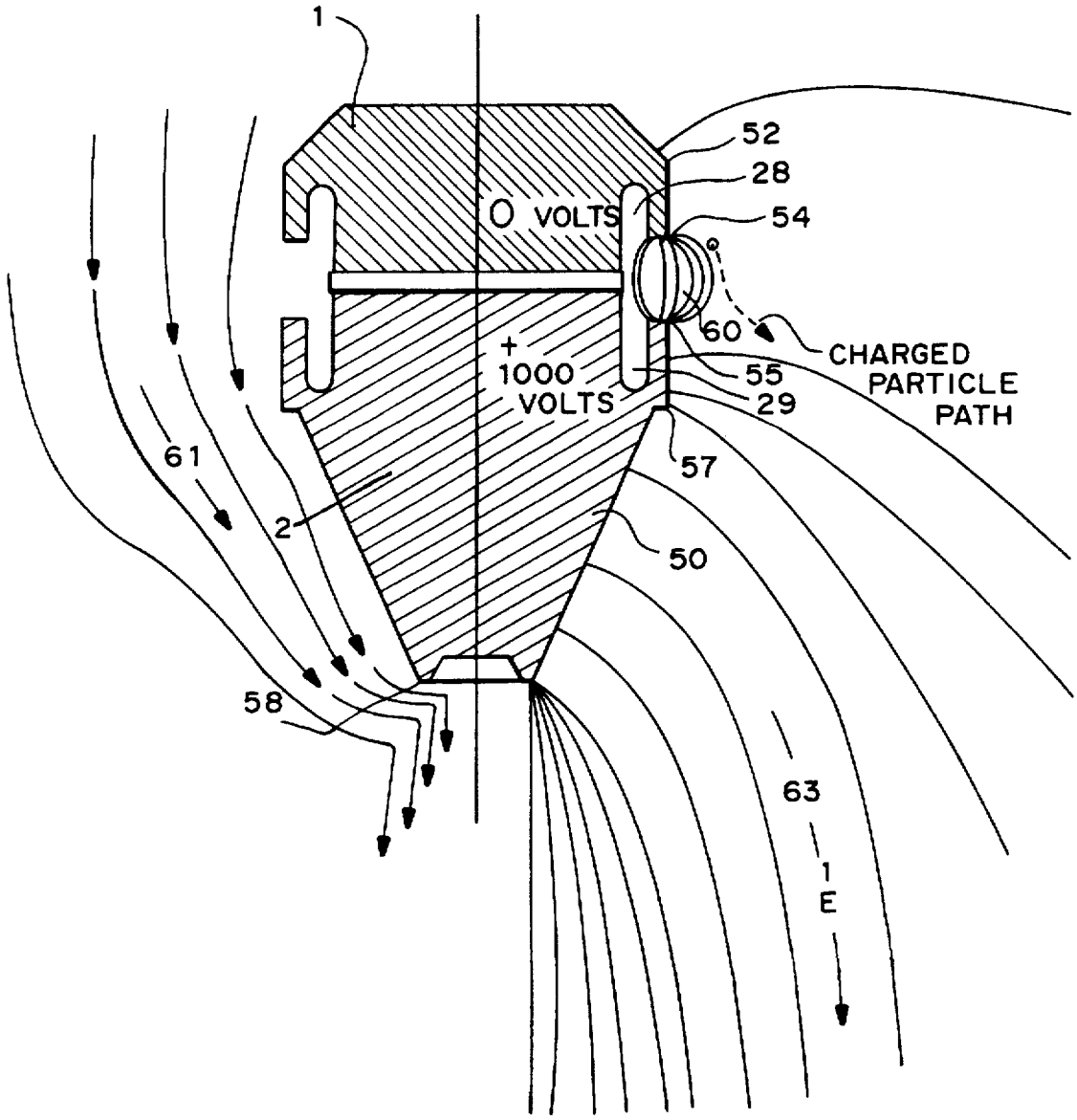
FIG. 7 shows the entrained air flow field and the electric field imposed on a nozzle according to a preferred embodiment of the present invention.

For the example shown in FIG. 7, surface contaminant fields forming on the body portion 1 attached to earthed sprayer parts result in a grounded surface of the body portion 1. Surfaces 50 of the cover portion 2 each carry a potential near that of the electrode 18. This results in electric field formation in the space separating the two portions. In the embodiment shown in FIG. 7, the field lines concentrate at the rims 54, 55 of the opposing cavities 28, 29, respectively, to create strong curvilinear electric field lines 60 as shown. Charged droplets returning to the nozzle along space-charge electric field lines originating at the spray cloud are prevented from entering the cavities, because as they become entrained in the increasingly intense curvilinear field, they accelerate and centrifugal force causes the droplets to be cast away from the sharply curved path of the field lines and into the entraining air flow field 61 surrounding the spray nozzle.

The air flow field 61 and this active electric field 60 work in concert, each moving stray charged droplets in the direction of the intended spray target. While negatively charged droplets resulting from a positive induction electrode are used for the purpose of the example, this resulting target-bound direction of the droplets moving in the curved field is the same regardless of the polarity of the induction electrode.

Figure 8:
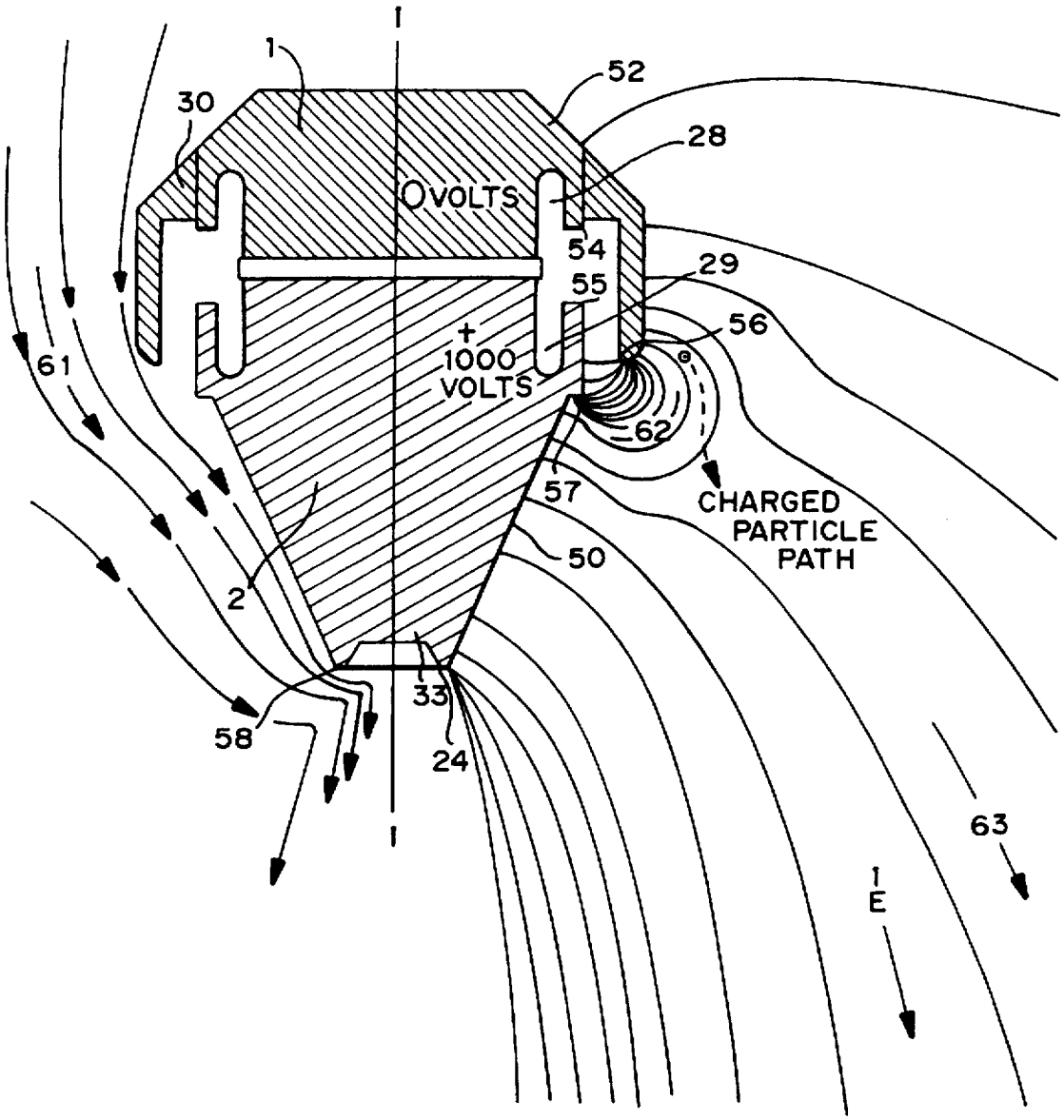
FIG. 8 shows the entrained air flow field and electric field imposed on a nozzle according to the present invention having a hood installed over the cavities for mechanical protection of the surfaces as well as for creating an enhanced curvilinear electric field for the exclusion of charged particles.

Referring to FIG. 8, the addition of a properly formed hood 30 over the cavity openings is used to create a very intense curvilinear field 62 across the entryway, between the hood rim 56 and an edge 57 formed on the nozzle cover 2. A typically 800 V positive potential on the surface film of the dielectric cover 2 positioned ½ cm from a ground plane will create a linear electric field of 1.6 kV/cm. In the ease of a sharp contour strategically formed on the body, opposite of a sharp lip on an earthed hood, the field shape is curvilinear and can be made to approach the dielectric breakdown strength of air if so desired, although such a field strength is undesirable because the resultant ion current adds to the power supply demand. A field strength of much less is required to cause the centrifugal force repulsion of 30 μm droplets charged at a level of −5 mC/kg. In severe conditions, where liquid accumulates on the hood 30 or rear of the body 1, the liquid moves to the hood rim 56 and is pulled into the curved field 62 prior to formation of ionization-prone drip points. This liquid tends to attract to the cover 2, avoiding the cavities 28, 29 along curvilinear lines, and is pulled by venturi action into the jet and re-atomized.

The cavity edges 54, 55 make use of the electric field actively maintained between nozzle and cavity edges, shaping the field to promote droplet repulsion from protected surface sites. Conversely, the forward end of the nozzle 58 is shaped to attract droplets toward the face surface 24 at the outlet 33, utilizing the passive electric field 63 created by the nearby charged spray cloud. The sharp convex shapes at the forward nozzle end 58 and the close proximity of this surface to the charged spray cloud, create an intense concentration of field lines around the face of the outlet 24. Charged droplets move toward the nozzle forward end 58 and most are re-entrained into the spray jet and driven towards the target before impinging on the nozzle. Spray liquid that does deposit is pulled along the surface 50 and re-atomized into the jet by the strong venturi action.

The high-velocity gas spray jet is used to repel and/or eject any charged or uncharged spray tending to collect onto nozzle surfaces. The localized high kinetic energy and velocity of the atomizing-gas jet as it and the accompanying charged droplets exit the jet outlet 33 produce a reduced pressure zone which pulls into the jet any spray tending to deposit and/or accumulate onto the small area faces of the abrasion resistant outlet 33, the face of the outlet 24, or other surfaces 50 of the cover 2. Obeying the conservation of momentum law, molecular impacts of the high velocity central gas jet exiting the nozzle at the forward jet outlet 33 impart a velocity and entrain a significant volume of surrounding ambient air. This entrainment accelerates additional volumes of air to sweep along external surfaces of the nozzle's body 1 and cover 2 into the central high-velocity gas/spray main jet exiting the nozzle. Such controlled air movements along properly contoured nozzle surfaces are beneficial to shear away deposited liquid before it can accumulate sufficiently to initiate induced electrical discharge peaks. In addition, small airborne spray droplets and other contaminant particulates which inadvertently diffuse into the protective cavities will be drawn out by a vacuum or venturi action similar to cigarette smoke drawn from the interior of a traveling vehicle through a slightly opened window.

The present invention may include contouring of the external shape of the nozzle body and the accompanying cover pieces so that the beneficial effects of centrifugal force exerted on charged particles moving in curvilinear electric fields work in concert with aerodynamic flow fields to preclude excessive liquid accumulation, droplet discharge by deposition, and induced corona and liquid slugging problems observed with conventional charging nozzles.

Figure 9:
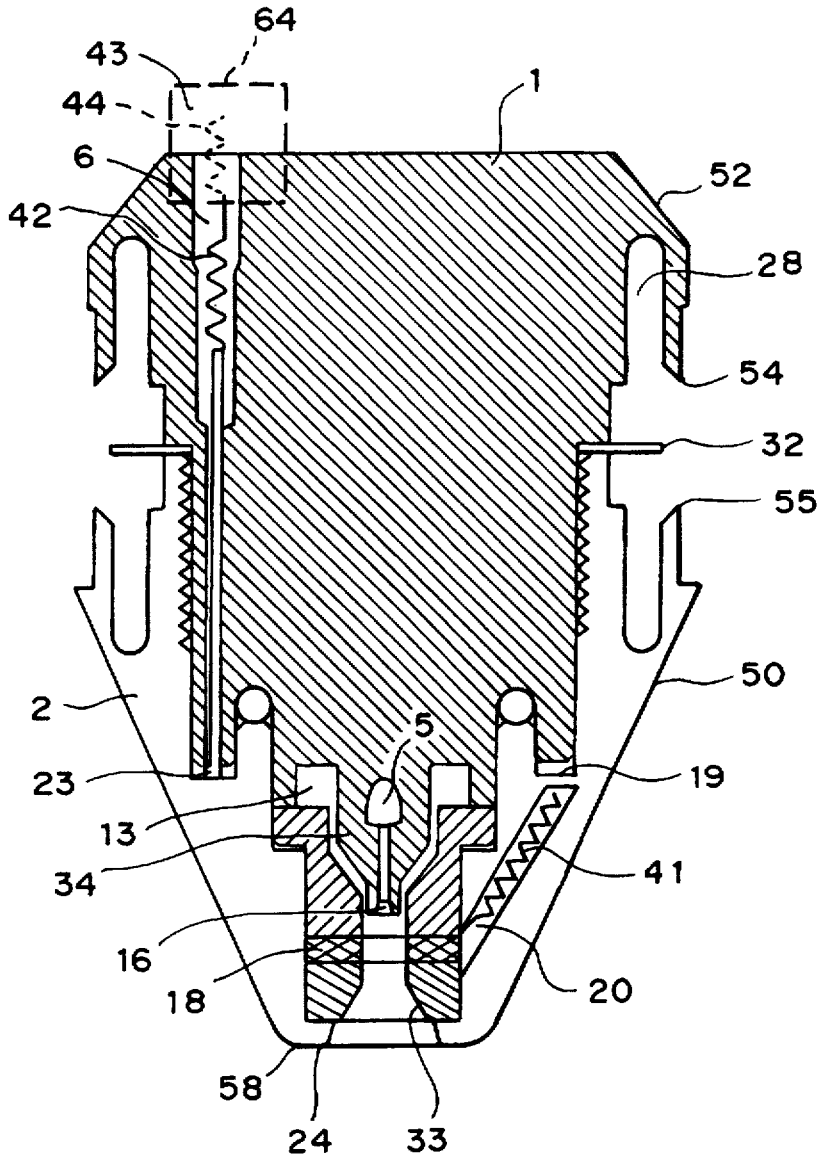
FIG. 9 shows a fourth embodiment of the induction charging nozzle according to the present invention in which resistive elements are installed within the nozzle between the power supply outlet and the nozzle's electrode.

FIG. 9 shows a cross-sectional elevational view taken through the axis of the electrical conduit 6 which terminates at the downstream end of the nozzle body 1 in a contact post 23. The electrical conduit 6 through the body 1 can contain a power supply wire, the power supply itself, or be formed of conductive or semiconductive material to connect to a power supply. If an electrode power source 43 is to be incorporated in the nozzle or attached to it, the preferred embodiment should include the low voltage input connections 64 on the low voltage body 1 section of the nozzle. In this case, the power supply 43 may be located on or within either the body 1 or the cover 2. If the power supply 43 is mounted at the cover portion 2, the low voltage input leads should be within the low voltage nozzle body 1. If it is desired to have low voltage input leads on the outside of a high voltage section of the nozzle, then proper high voltage insulation of the leads must be used and a protective hood or other structure should be used to protect a portion of the leads to minimize electrical tracking along wire insulation surfaces toward connectors or earthed sprayer parts.

In the embodiment shown in FIG. 9 in which the high voltage conductor is in a conduit 6 in the nozzle body 1, the conduit 6 has a terminal end 23 which contacts with a conductive surface 19 which is electrically connected to the electrode in the cover portion 2. The conductive surface 19 can be a metal or conductive plastic annulus inserted in the cover cavity or it can be a conductive plastic which is poured or injected. It is preferable that the surface be continuous and surround the inside of the cover portion in order to set up an equipotential on the surface film on the internal surfaces 59 of the cover upstream of the electrode 18 to the conductive surface 19. This equipotential surface 59 prevents current paths from forming from the electrode 18 rearward to the any of the critical surfaces of the nozzle atomization zone and also prevents damage to the twin-fluid tip 12 region. In the event of a direct short circuit between the liquid-orifice tip 12 and the electrode 18 the current is directed towards the liquid stream itself, instead of along paths on the dielectric surfaces, and the liquid stream's resistive path and the resistive element on the electrode input limits gross arcing at the tip.

An electrical passageway 20 is formed in the cover 2 between the conductive surface 19 and the electrode 18. A wire or other highly conductive material, or a fixed resistor 41, can be inserted in the passageway 20, or electrical contact can be through a conductive or semiconductive material which may be injected or poured, such as carbon-loaded plastics. When it is desirable to use a resistive element to contact the electrode, a resistive element may be installed in the passageway 20 or in the electrical channel in the body 6. The latter is preferable for safety and to ensure equal potentials exist on interior surfaces of the cover components to prevent surface currents there. When a single power supply is used with a single nozzle, a lower-power unregulated supply can be used if the output loading characteristics are desirable, or a limiting resistor can be placed on a power supply circuit.

When several nozzles are to be operated from a single power supply it may be desirable to use a resistive element to each nozzle, whether these resistors are contained within the power supply or the nozzle. This prevents one shorted nozzle in the set from reducing the charging voltage at other nozzles operating from the same power source.

The methods described in this invention to establish and maintain low surface leakage and a high resistance between the nozzle power supply output and earth allow the use of a proper current limiting resistor without sacrificing a significant voltage to the electrode. A resistor placed in the body or anywhere before the electrode 18 has the benefit of limiting current to a non-hazardous level in case contact with the electrode 18, or the contaminated nozzle surfaces is made. But, because of series connection with contaminated surface resistance, proper use has eluded those who designed conventional nozzles. Safety is a key motivation to reduce power supply requirements for induction nozzle. Often 9 mA at 800 volts can be drawn from contaminated outer surfaces of some conventional commercial nozzles of this general induction charging type which have oversized power supplies to compensate for problematic high leakage currents. The greatest hazard created is generally not from the electrical shock itself, but from the action of the person quickly pulling away from the source and falling or hitting something. However, previous attempts at using limiting resistors or lower-power unregulated supplies, while successful for safety, reduce the electrode voltage and charging.

Figure 10:
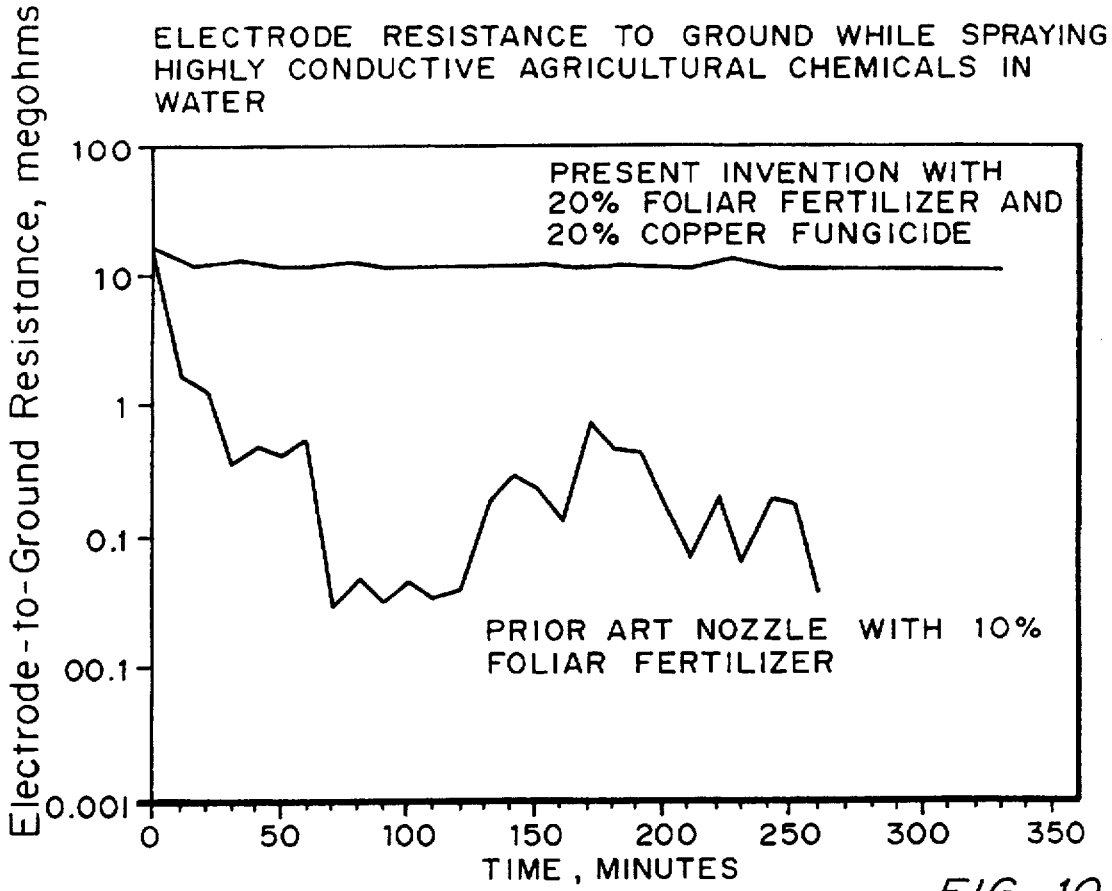
FIG. 10 shows a semilogarithmic graph of the electrode resistance to ground measured over a time span while spraying a common highly conductive agricultural mixture comparing a prior art nozzle to a nozzle according the present invention.

The graph shown in FIG. 10 illustrates the results of a test where the electrical resistance values from the induction electrodes to ground of a conventional nozzle and a nozzle according to the present invention were monitored during a period of time while spraying water containing common agricultural chemicals. The spray mixture resistivities were near 28 ohm-cm for each of the solutions (in comparison with a typical 5,000–10,000 ohm cm value for tap water). However the foliar fertilizer mixture also containing copper fungicide characteristically forms a thick coating on the nozzles and could not be tested with success in the conventional nozzle. During this test a fan was set to blow a portion of spray back into the face of the nozzles to simulate the situation often encountered when charging nozzles are positioned for spraying in opposing directions, as in vineyard spraying, for example. At the beginning of the test of the conventional nozzle, the nozzle surfaces were cleaned and the electrode-to-ground resistance was 11 megohms, which was near the 15 megohm value of the power supply output shunt resistor. Within one hour the electrode resistance to ground was reduced to less than 1 kilohm and varied substantially with the observed level of resistive coating present on the nozzle. In this case a power supply limiting resistor was not used in the prior art nozzle and could not be used without significantly reducing the electrode voltage. The upper curve of FIG. 10 shows the results of the test using a nozzle according to the present invention spraying a much heavier mixture of the very conductive foliar fertilizer with a substantial amount of copper fungicide added. In this case the initially high system resistance to ground was maintained throughout the entire testing time span and a 1.2 megohm series resistor was successfully utilized. No electrical shock could be felt when touching the charging nozzle cover, even when it was substantially coated by the spray.

Figure 11:
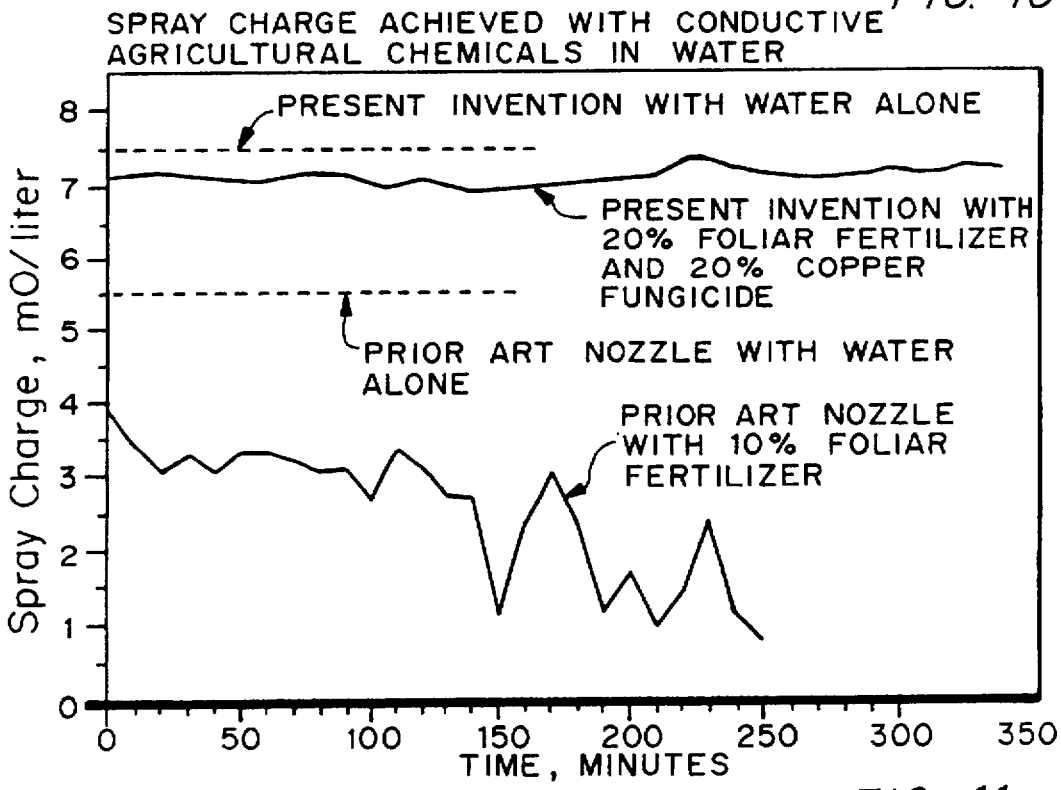
FIG. 11 is a graph showing the charging level achieved over time for a nozzle according to the invention compared with that of a prior art nozzle.

Also during this test, the spray charge level was monitored for each nozzle and these results are shown in FIG. 11. The spray charge was determined by measuring the spray cloud current which was converted to charge per unit spray volume based on the liquid flow rate. For example, each nozzle had a liquid flowrate of 120 ml/min so a spray cloud current level of 10 μA converts to a charge level of 5 mC/l. It has been determined previously that a desirable level of charging for a two-fold deposition benefit versus uncharged spray is in the range of 3 mC/l or greater. The prior art nozzle charged water spray, having an electrical resistivity value of 6500 ohm cm, to a level of 5.5 mC/l. However, with the 10% of chemical added to the spray liquid the charging was reduced to only 3.8 mC/l initially and was quickly further reduced to less than 2 mC/l as nozzle surfaces became contaminated. The presently invented nozzle charged water spray at a level of 7.5 mC/l, and when the 20% level of the two chemicals were added the charging level was maintained at 7 mC/l over the entire 5–6 hour time span of the test.

Figure 12:
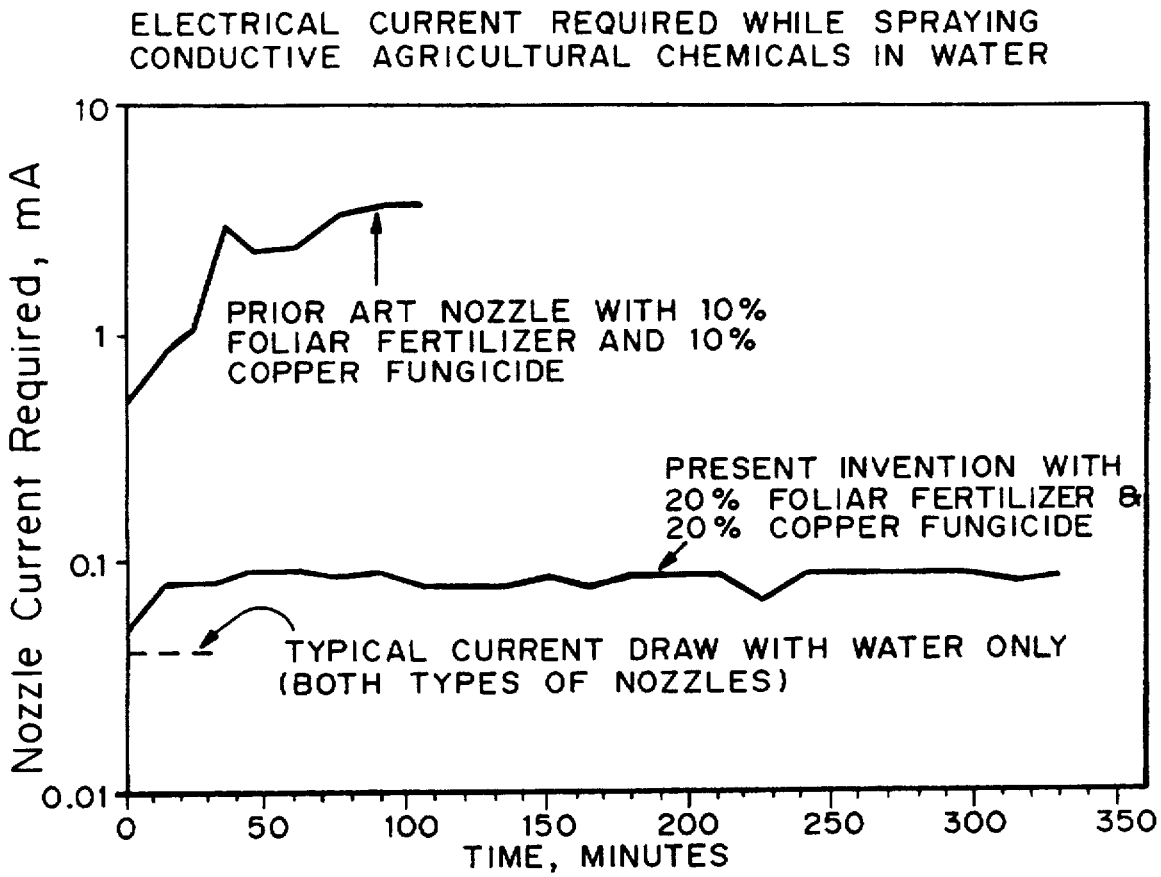
FIG. 12 is a semilogarithmic graph of the typical power supply current required over a day-long time span to operate a nozzle according to the invention compared with that for a prior art nozzle.
Figure 13:
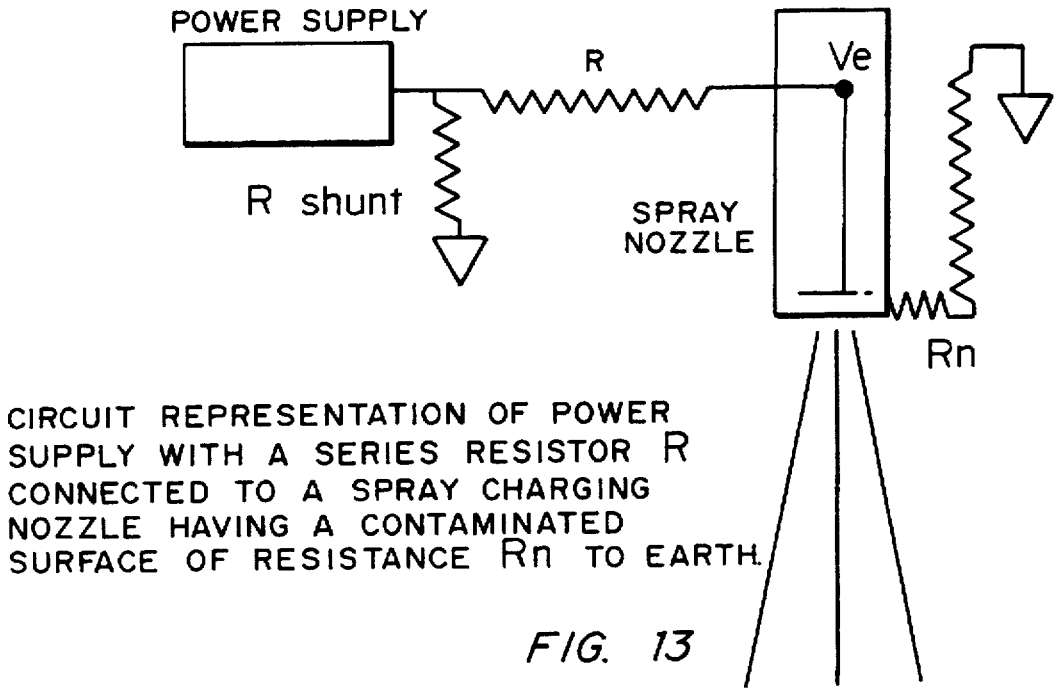
FIG. 13 is a schematic representation of a spray-charging nozzle system in which a resistor is interposed between the power supply and a nozzle having a contaminated resistive surface.

FIG. 12 shows a separate test where nozzle power supply current was monitored for the two nozzles as previously. In this case however, copper fungicide as well as foliar fertilizer was added to the mixture sprayed through the conventional nozzle. The nature of the copper causes more of a nozzle coating than the foliar fertilizer alone. The final result was that the nozzle was irreversibly damaged: first the atomization channel became deformed (altering the atomization and internal charging field geometry), and in under two hours the dielectric liquid-orifice tip was pitted to a severe degree and the nozzle would no longer charge the spray over 0.8 mC/l. Before the gross failure of the tip, usually the current requirement for the prior art nozzle was over 40-fold greater than the current required to operate the nozzle according to the present invention, while the charging level achieved with the present invention was over 3-fold higher than the conventional nozzle. Thus, the present invention provides a 120-fold greater spray current output per unit of nozzle current input the does the conventional nozzle.

Another benefit confirmed during these spray trials was that with the new high impedance nozzle, liquid did not form into electric discharge peaks and ionize at the face of the nozzle even when liquid was intentionally poured onto the face. Induced ionization did, however, occur readily and continuously with the prior art device. In addition, the conventional nozzle exhibited a visible corona glow at the rim of the liquid-orifice tip, indicating ionization and electric discharge from the liquid as it emerged from the tip. While this can enhance charging by ion attachment, it will eventually cause failure of the liquid tip due to physical pitting and deformation of the tip rim.

The foregoing disclosure has addressed preferred embodiments of the invention. Other structures, designs, dimensions, components, modifications, deletions and/or additions, which may be aimed at creating nozzles or portions of nozzles which produce effects similar to nozzles and portions of nozzles as disclosed above may be employed without departing from the scope or spirit of the invention.

What is claimed is:

1. An induction spray-charging nozzle comprising:

a. a body including a liquid channel and a gas channel, the liquid channel terminating in a tip;

b. a cover removably connected to the body, said cover comprising at least partially insulative material, the cover including:

(i) an inner surface which cooperates with an outer surface of the body to form at least one void into which liquid emanating from the tip and gas emanating from the body may flow, the cover forming a channel through which the liquid and the gas flow, the channel adapted in shape to cause atomized liquid and gas to emanate properly from the channel into air surrounding the nozzle;

(ii) an electrode at least partially surrounding the channel, adapted to create electrical charge in the liquid flowing in the channel;

(iii) an outer surface which is shaped to reduce turbulence of air flowing adjacent to the cover; and c. at least one annular shaped cavity formed on an outside surface of the nozzle, the cavity adapted in shape to reduce reception of liquid and gas and other surface contaminants, and to reduce current flowing between the electrode and electrical ground.

2. A nozzle according to claim 1 in which the electrode is formed of abrasion resistant material.

3. A nozzle according to claim 1 further comprising an abrasion resistant outlet forming a portion of the channel.

4. A nozzle according to claim 3 in which the body tip contains structure adapted to modify flow of the gas emanating from body into an at least partially helical pattern.

5. A nozzle according to claim 3 in which the outlet is formed of ceramic material.

6. A nozzle according to claim 1 further comprising a flange disposed between an outer surface of the body and an outer surface of the cover, adapted to reduce the liquid, gas and other surface contaminants received in the annular cavity.

7. A nozzle according to claim 1 further comprising a flange disposed between an outer surface of the body and an outer surface of the cover, adapted to reduce current flow between the electrode and ground.

8. A nozzle according to claim 1 in which the body comprises the annular cavity.

9. A nozzle according to claim 1 in which the cover comprises the annular cavity.

10. A nozzle according to claim 1 in which the body and the cover each comprise one of the annular cavities.

11. A nozzle according to claim 1 in which the outer surface of the cover is substantially forwardly tapered toward an outlet of the channel.

12. A nozzle according to claim 1 in which the cover contains a conductive surface which renders predetermined locations on inner surfaces of the cover to be at substantially equal potential.

13. A nozzle according to claim 1 further comprising a hood connected to the nozzle, the hood adapted in shape to shield at least part of outside surfaces of the nozzle from liquid, gas and other surface contaminants.

14. A nozzle according to claim 1 further comprising a hood connected to the nozzle, the hood adapted in shape to shield at least part of said annular cavity from liquid, gas and other surface contaminants.

15. A nozzle according to claim 1 in which the electrode is coupled to a power supply via a resistive element that features a resistance of at least one thousand ohms.

16. A nozzle according to claim 15 in which the resistive element is contained in the cover.

17. A nozzle according to claim 15 in which the resistive element is contained in the body.

18. A nozzle according to claim 15 in which the resistive element is contained in a conductor that couples the nozzle to the power supply.

19. A nozzle according to claim 15 comprising a plurality of resistive elements whose total resistance exceeds one thousand ohms.

20. A nozzle according to claim 1 in which the body further comprises a conductive element adapted to assist in applying voltage to the electrode.

21. A nozzle according to claim 1 in which the cover further comprises a conductive element adapted to assist in applying voltage to the electrode.

22. A nozzle according to claim 21 in which the conductive element in the cover is formed at least partially of a thermoplastic material which features a resistance of at least one thousand ohms.

23. A nozzle according to claim 21 in which the conductive element in the cover features a resistance of at least one thousand ohms.

24. A nozzle, comprising:

a. a body including a liquid channel and a gas channel, the liquid channel terminating in a tip;

b. a cover removably connected to the body, said cover comprising at least partially insulative material, the cover including:

(i) an inner surface which cooperates with an outer surface of the body to form at least one void into which liquid emanating from the tip and gas emanating from the body may flow, the cover forming a channel through which the liquid and the gas flow, the channel adapted in shape to cause atomized liquid and gas to emanate properly from the channel into air surrounding the nozzle;

(ii) an electrode at least partially surrounding the channel, adapted to create electrical charge in the liquid flowing in the channel;

(iii) an outer surface which is shaped to reduce turbulence of air flowing adjacent to the cover;

c. a conductive element adapted to couple the electrode to a power supply;

d. a conductive surface connected to the cover, coupled to the conductive element and adapted to cause the potential at predetermined locations on inner surfaces of the cover to be substantially at the same potential; and e. at least one annular shaped cavity formed on an outside surface of the nozzle, the cavity adapted in shape to reduce reception of liquid, gas and other surface contaminants, and to reduce current flowing between the electrode and electrical ground.

25. A nozzle according to claim 24 in which each of the body and the cover comprises an annular shaped cavity.

26. A nozzle according to claim 24 in which only one of body and the cover comprises an annular shaped cavity.

27. A nozzle according to claim 24 in which the electrode is formed of an abrasion resistant material.

28. A nozzle according to claim 24 further comprising an abrasion resistant outlet forming a portion of the channel.

29. A nozzle according to claim 28 in which the outlet is formed of ceramic material.

30. A nozzle according to claim 24 in which the conductive element features a resistance of at least one thousand ohms.

31. A nozzle according to claim 24 in which outside surface of the cover is substantially forwardly tapered toward an outlet of the channel.

32. A nozzle according to claim 24 further comprising a flange interposed between the body and the cover, the flange adapted in shape at least partially to shield said annular shaped cavity from liquid, gas and other surface contaminants.

33. A nozzle according to claim 24 further comprising a flange interposed between the body and the cover, the flange adapted in shape to reduce current between the electrode and electrical ground.

34. A nozzle according to claim 24 further comprising a hood attached to the nozzle, the hood adapted in shape at least partially to shield said annular shaped flange from liquid, gas and other surface contaminants.

35. A nozzle, comprising:

a. a body including a liquid channel and a gas channel, the liquid channel terminating in a tip;

b. a cover removably connected to the body, said cover comprising at least partially insulative material, the cover including:

(i) an inner surface which cooperates with an outer surface of the body to form at least one void into which liquid emanating from the tip and gas emanating from the body may flow, the cover forming a channel through which the liquid and the gas flow, the channel adapted in shape to cause atomized liquid and gas to emanate properly from the channel into air surrounding the nozzle;

(ii) an electrode formed of abrasion resistant material positioned adjacent to and at least partially surrounding the channel, adapted to create electrical charge in the liquid flowing in the channel; and (iiii) a conductive element adapted to couple the electrode to a power supply; and c. an outside surface formed on the nozzle adapted in shape to reduce current flowing between the electrode and electrical ground, said outside surface substantially forwardly tapered toward an outlet of the channel.

36. A nozzle according to claim 35 further in which the cover comprises an electrical surface coupled to the conductive element which is adapted to maintain locations on inner surfaces of the cover at substantially equal potential.

37. A nozzle according to claim 35 in which the conductive element features a resistance of at least one thousand ohms.

38. A nozzle according to claim 35 further comprising a hood attached to the nozzle adapted in shape to shield at least part of the nozzle from liquid, gas and other surface contaminants.

39. A nozzle according to claim 35 in which the outside surface formed on the nozzle adapted in shape to reduce current flowing between the electrode and electrical ground comprises a flange extending from the nozzle adapted in shape to reduce current flowing from the electrode to ground.

40. A nozzle according to claim 35 in which the outside surface formed on the nozzle adapted in shape to reduce current flowing between the electrode and electrical ground comprises a hood extending from the nozzle adapted in shape to reduce current flowing from the electrode to ground.

41. A nozzle, comprising:

a. a body including a liquid channel and a gas channel, the liquid channel terminating in a tip;

b. a cover removably connected to the body, said cover comprising at least partially insulative material, the cover including:

(i) an inner surface which cooperates with an outer surface of the body to form at least one void into which liquid eminating from the tip and gas emanating from the body may flow, the cover forming a channel through which the liquid and the gas flow, the channel adapted in shape to cause atomized liquid and gas to emanate properly from the channel into air surrounding the nozzle;

(ii) an electrode formed of abrasion resistant material positioned adjacent to and at least partially surrounding the channel, adapted to create electrical charge in the liquid flowing in the channel; and (iii) a conductive element adapted to couple the electrode to a power supply; and c. an outside surface formed on the nozzle adapted in shape to reduce current flowing between the electrode and electrical ground, said outside surface comprising an annular cavity.

42. A nozzle according to claim 41 further comprising another annular cavity formed on an outer surface of the body, the cavities adapted in shape to receive reduced amounts of liquid, gas and other surface contaminants.

43. A nozzle according to claim 41 in which said annular cavity is adapted in shape to receive reduced amounts of liquid, gas and other surface contaminants.

44. A nozzle according to claim 41 in which the annular shaped cavity is adapted in shape to reduce current flowing from the electrode to ground.

45. A nozzle according to claim 44 in which the annular shaped cavity is formed on the outer surface of the cover.

46. A nozzle according to claim 44 in which the annular shaped cavity is formed on the outer surface of the body.

47. A nozzle according to claim 44 in which an annular shaped cavity is formed on the outside surface of each of the cover and the body.

48. A nozzle, comprising:

a. a body that includes a liquid channel for transmission of liquid and a gas channel for transmission of gas, the liquid channel terminating in a tip, the tip and the body connected with no seams through which electrical current flows to the liquid;

b. a cover removably connected to the body, said cover comprising at least partially insulative material, the cover including:

(i) an inner surface which cooperates with an outer surface of the body to form at least one void into which liquid emanating from the tip and gas emanating from the body may flow, the cover forming a channel through which the liquid and the gas flow, the channel adapted in shape to cause atomized liquid and gas to emanate properly from the channel into air surrounding the nozzle; and (ii) an electrode formed of abrasion resistant material positioned at least partially surrounding the channel, adapted to cream electrical charge in the liquid flowing in the channel;

c. the liquid grounded upstream from the tip;

d. at least one surface formed on the nozzle to increase impedance of the surface to currents flowing between the electrode and ground, said surface; and e. an outside surface formed on the nozzle, said outside surface comprising at least one annular shaped cavity formed on the surface of the nozzle and adapted in shape to reduce current flowing from the electrode to ground.

49. A nozzle according to claim 48 further comprising a port communicating with said gas channel and adapted to introduce gas into said at least one cavity in order to purge said at least one cavity.

50. An induction spray-charging nozzle comprising:

a. a body including a liquid channel and a gas channel;

b. a cover connected to the body, said cover comprising at least partially insulative material, the cover including:

(i) an inner surface which cooperates with an outer surface of the body to form at least one void into which liquid and gas emanating from the body flow, the cover forming a channel through which the liquid and the gas flow, the channel adapted in shape to cause atomized liquid and gas to emanate properly from the channel into air surrounding the nozzle;

(ii) an electrode at least partially surrounding the channel, adapted to create electrical charge in the liquid flowing in the channel; and (iii) an outer surface which contains:

a. at least one cavity adapted in shape to reduce current flowing from the electrode to ground; and b. at least one field concentrator adapted in shape to concentrate the intensity of electrical fields in the vicinity of the field concentrator.

51. A nozzle according to claim 50 in which the field concentrator is located in the vicinity of the cavity in order to deflect foreign matter from entering the cavity.

52. A nozzle according to claim 50 in which the field concentrators are edges formed on the surface of the nozzle.

53. A nozzle according to claim 50 in which the cavities are annular cavities formed in the surface of the nozzle.

54. A nozzle according to claim 50 in which the field concentrators are adapted in shape to cause formation of curved electrical field lines in the vicinity of the field concentrators.

55. A nozzle, comprising:

a. a body that includes a liquid channel for transmission of liquid and a gas channel for transmission of gas, the liquid channel terminating in a tip, the tip and the body connected with no seams through which electrical current flows to the liquid;

b. a cover removably connected to the body, said cover comprising at least partially insulative material, the cover including:

(i) an inner surface which cooperates with an outer surface of the body to form at least one void into which liquid emanating from the tip and gas emanating from the body may flow, the cover forming a channel through which the liquid and the gas flow, the channel adapted in shape to cause atomized liquid and gas to emanate properly from the channel into air surrounding the nozzle; and (ii) an electrode formed of abrasion resistant material positioned at least partially surrounding the channel, adapted to create electrical charge in the liquid flowing in the channel;

c. the liquid grounded upstream from the tip; and d. at least one surface formed on the nozzle to increase impedance of the surface to currents flowing between the electrode and ground; and e. an outer surface formed on said nozzle, said outer surface substantially forwardly tapered toward an outlet of the channel.

56. A nozzle according to claim 55 in which the surface formed on the nozzle comprises a flange extending from the nozzle adapted in shape to reduce current flowing from the electrode to ground.

57. A nozzle according to claim 55 in which the outside surface formed on the nozzle comprises a hood extending from the nozzle adapted in shape to reduce current flowing from the electrode to ground.

58. A nozzle according to claim 55 in which the outside surface formed on the nozzle comprises at least one annular shaped cavity formed on the surface of the nozzle and adapted in shape to reduce current flowing from the electrode to ground.

59. A nozzle according to claim 58 in which the annular shaped cavity is formed on the outer surface of the cover.

60. A nozzle according to claim 58 in which the annular shaped cavity is formed on the outer surface of the body.

61. A nozzle according to claim 58 in which at least one annular shaped cavity is formed on the outside surface of each of the body and the cover.

62. A nozzle according to claim 58 further comprising a port communicating with the gas channel and adapted to introduce gas into the cavities in order to purge the cavities.

63. A nozzle according to claim 55 in which an outer surface of the cover is adapted in shape to reduce turbulence of airflow in the vicinity of the cover.

64. A nozzle according to claim 55 in which the void into which liquid emanating from the tip and gas emanating from the body flows is non-convergent.

65. A nozzle according to claim 55 in which the nozzle further comprises a conductive element adapted to assist in applying voltage to the electrode, and in which the nozzle is adapted to interrupt electrical contact between the conductive element and the electrode when the cover is removed.

66. A nozzle according to claim 55 in which the cover includes an outside surface adapted in shape to act as an electric field barrier when coated with surface contaminants.

67. A spray-charging nozzle, comprising:

a. a nozzle body including a liquid channel for transmission of liquid, a gas channel, the nozzle body containing no seams through which electrical current flows to the liquid;

b. a cover disposed on said body in fluid-tight manner, said cover including an outlet port through which atomized liquid and gas emanate through an outlet face of the cover into the air surrounding the nozzle in a desired spray pattern, said cover forming no portion of said liquid channel;

c. an electrode disposed within said outlet port, upstream of said outlet face of said cover, downstream of said fluid channel and coupled to a power supply through no conduits which communicate with said liquid channel, said electrode adapted to impart a charge to the liquid that emanates into the air, charge from said electrode unable to migrate on surfaces of said nozzle between said electrode and a liquid line for providing liquid to said liquid channel without migrating across external surfaces of said nozzle:

d. a liquid line, a gas line, and an electrical line for providing liquid, gas and voltage to the liquid channel, gas channel and electrode, respectively;

e. the liquid grounded upstream of the outlet port; and f. the nozzle including an outside surface adapted in shape to increase impedance to current flowing from the electrode to ground.

68. A nozzle according to claim 67 in which the nozzle outside surface comprises a flange extending from the nozzle adapted in shape to reduce current flowing from the electrode to ground.

69. A nozzle according to claim 67 in which the nozzle outside surface comprises a hood extending from the nozzle adapted in shape to reduce current flowing from the electrode to ground.

70. A nozzle according to claim 69 in which the hood is adapted to reduce turbulence in air flowing in the vicinity of the nozzle.

71. A nozzle according to claim 67 in which the nozzle outside surface comprises at least one annular shaped cavity formed on the surface of the nozzle and adapted in shape to reduce current flowing from the electrode to ground.

72. A nozzle according to claim 71 in which the annular shaped cavity is formed on the outer surface of the cover.

73. A nozzle according to claim 71 in which at least one annular shaped cavity is formed on the outside surface of each of the body and the cover.

74. A nozzle according to claim 71 in which the annular shaped cavity is formed on the outer surface of the body.

75. A nozzle according to claim 67 further comprising a hood connected to at least one of the liquid line, gas line and electrical line for protecting surfaces of the nozzle against undesired deposition of liquid, gas and other surface contaminants.

76. A nozzle according to claim 75 in which the hood is adapted in shape to reduce current flowing from the electrode to ground.

77. An induction spray-charging nozzle comprising:

a. a body including a liquid channel terminating in a tip and a cover removably connected to the body;

b. the cover including an electrode and forming a channel through which liquid and gas flow, the channel adapted in shape to cause atomized liquid and gas to emanate properly from an outlet of the channel into the air surrounding the nozzle;

c. at least one outer surface that is:

(i) adapted in shape to reduce contaminant deposit on the nozzle by including a tapered surface that is tapered toward the outlet to (A) present a smaller surface area in the vicinity of the outlet than at other locations on the nozzle; and (B) present an aerodynamic surface that substantially decreases turbulent airflow in the vicinity of the nozzle; and (ii) adapted in shape to reduce electrical current flowing between the electrode and ground, by including surface features that are adapted in shape to increase the impedance presented by the outer surface to current flowing from the electrode to ground; and d. an electrode power supply which is coupled to the nozzle structure.

78. A nozzle according to claim 77 in which the wall of the channel is at least partially made of abrasion resistant material.

79. A nozzle according to claim 78 in which the wall of the channel is at least partially made of ceramic material.

80. A nozzle according to claim 77 in which said power supply is mounted to the body portion of the nozzle.

81. A nozzle according to claim 77 in which said power supply is mounted within the body portion of the nozzle.

82. A nozzle according to claim 77 in which said power supply is mounted to the cover portion of the nozzle.

83. A nozzle according to claim 77 in which said power supply is mounted within the cover portion of the nozzle.

84. A nozzle according to claim 77 in which said power supply has input leads which emanate from a low voltage body portion of the nozzle.

85. A nozzle according to claim 77 in which said power supply has input leads which have shields formed on them to reduce contaminant deposit.

86. A nozzle, comprising:

a. a body including a liquid channel and a gas channel, the liquid channel terminating in a tip;

b. a cover removably connected to the body, said cover comprising at least partially insulative material, the cover including:

(i) an inner surface which cooperates with an outer surface of the body to form at least one void into which liquid emanating from the tip and gas emanating from the body may flow, the cover forming a channel through which the liquid and the gas flow, the channel adapted in shape to cause atomized liquid and gas to emanate properly from the channel into air surrounding the nozzle;

(ii) an electrode formed of abrasion resistant material positioned adjacent to and at least partially surrounding the channel, adapted to create electrical charge in the liquid flowing in the channel; and (iii) a conductive element adapted to couple the electrode to a power supply; and c. an outside surface formed on the nozzle adapted in shape to reduce current flowing between the electrode and electrical ground, said outside surface adapted in shape to reduce turbulence of air flowing around the nozzle and electrically to deflect matter emanating from the nozzle from entering cavities formed on outside surfaces of the nozzle.

* * * * *